US008640639B2

(12) United States Patent
Brunner et al.

(10) Patent No.: US 8,640,639 B2
(45) Date of Patent: Feb. 4, 2014

(54) METHOD FOR CUTTING THE LOWER AND AT LEAST ONE UPPER THREAD AND A METHOD FOR LEAD-IN STITCHING AS WELL AS A DEVICE FOR IMPLEMENTING THE METHOD

(75) Inventors: Severin Brunner, Steckborn (CH); Hans Flückiger, Oetwil am See (CH); André Stucki, Steckborn (CH)

(73) Assignee: BERNINA International AG, Steckborn (CH)

( * ) Notice: Subject to any disclaimer, the term of this patent is extended or adjusted under 35 U.S.C. 154(b) by 15 days.

(21) Appl. No.: 13/406,855

(22) Filed: Feb. 28, 2012

(65) Prior Publication Data

US 2013/0055940 A1 Mar. 7, 2013

(51) Int. Cl.
*D05B 65/00* (2006.01)

(52) U.S. Cl.
USPC ..... 112/475.17

(58) Field of Classification Search
USPC ..... 112/285–302, 197, 274, 475.01, 475.17
See application file for complete search history.

(56) References Cited

U.S. PATENT DOCUMENTS

| | | | | |
|---|---|---|---|---|
| 4,365,568 | A | 12/1982 | Ross | |
| 5,370,073 | A * | 12/1994 | Hayashi | 112/291 |
| 6,814,018 | B1 * | 11/2004 | Chuo | 112/292 |
| 7,603,957 | B2 * | 10/2009 | Shiraishi | 112/298 |
| 7,926,434 | B2 * | 4/2011 | Hanada | 112/292 |
| 8,015,934 | B2 * | 9/2011 | Hanada | 112/292 |
| 8,020,502 | B2 * | 9/2011 | Hanada | 112/285 |
| 2013/0055940 | A1 * | 3/2013 | Brunner et al. | 112/292 |

FOREIGN PATENT DOCUMENTS

| | | |
|---|---|---|
| DE | 1968920 | 9/1967 |
| DE | 3715603 | 6/1988 |
| DE | 10357563 | 7/2004 |

* cited by examiner

*Primary Examiner* — Danny Worrell
(74) *Attorney, Agent, or Firm* — Volpe and Koenig, P.C.

(57) ABSTRACT

A method for cutting the lower and at least one upper thread for lead-in embroidering or lead-in sewing is performed with a device including thread catchers (19*a*-19*c*) connected with each other in a fixed manner and layered over top of each other, formed of sheet metal, as well as spring and thread tightening plates (31 and 41) arranged above and below the thread catchers, which move back and forth against a blade (29), and a thread wiper unit. The device is exclusively operated by a drive moving back and forth and driving the thread cutting and lead-in stitching unit (5).

7 Claims, 23 Drawing Sheets

METHOD FOR CUTTING THE LOWER AND AT LEAST ONE UPPER THREAD AND A METHOD FOR LEAD-IN STITCHING AS WELL AS A DEVICE FOR IMPLEMENTING THE METHOD

CROSS-REFERENCE TO RELATED APPLICATIONS

This application claims the benefit of Swiss Patent Application No. 00339/11, filed Feb. 28, 2011, which is incorporated herein by reference as if fully set forth.

BACKGROUND

The invention is directed to a method for cutting the lower and at least one upper thread at the end of a sewing or embroidering process, a method for lead-in stitching at the beginning of a sewing or embroidering process, as well as a device for performing these methods.

A flawless beginning of a sewing or embroidering stitching always requires that the upper and the lower thread exhibit a suitable length and, if possible, position in reference to the sewing or embroidering material. This condition is usually not given, though, when a sewing or embroidering process is ended in the usual fashion. When the threads are not located in a defined good position no optimal first stitch and/or first knot is achieved. This can lead to problems in further processing of the sewing or embroidering material, and particularly it is undesirable for esthetic and functional aspects.

SUMMARY

One objective of the present invention comprises providing a method and a device for a sewing machine with a CB-hook (central bobbin-hook) like device or a CB-hook, which allows at the end of a sewing or embroidering process the cutting-off of the upper and the lower thread at a desired length and provides the loose ends of the upper and the lower thread at the machine in an optimal position for lead-in stitching and/or sewing. Another objective of the invention comprises providing a device for implementing such a method.

These objectives are attained in the methods as well as the device according to the invention.

These objectives are flawlessly attained in a displacement of the upper and the lower thread perpendicularly in reference to the axis of the needle during the stitch formation and by a temporary holding and/or braking of the upper thread underneath the stitching plate. The use of the thread cutting and/or lead-in stitching unit according to the invention allows performing the processing steps without any additional thread tensioning or thread clamping system or any inversing of the rotary direction of the machine and/or its primary shaft. The thread cutting and lead-in stitching unit holds the loose thread (s) until the second stitch and allows a tight knot in the material. The drive of this unit occurs by coupling it via a stroke magnet to the primary drive train, which magnet acts as an actuator. A mandatorily guided cam drive provides the required kinematics. The differentiation if the thread cutting function or the lead-in stitching function is to be performed occurs exclusively via the electrification of a stroke magnet, dependent on the upper shaft, at the respectively predetermined rotary angle of the primary shaft. It is advantageously achieved to increase the cutting speed or to reduce the cutting time and to obtain a high lead-in stitching quality. Here, the risk of the thread jamming in the hook path can be minimized. Additionally, any lateral displacement of the needle is not required for and/or during the thread cutting function. Furthermore, the method according to the invention allows thread cutting the lead-in stitching with CB-hook systems and rotary hook systems.

The activation mechanics for performing the thread cutting and lead-in stitching functions comprise a very simple design and includes a number of plates located over top of each other with different configurations and ends specifically embodied for said functions. Some of these plates are jointly pushed forward and backward by a linearly acting drive and, in order to bring the thread ends into an optimal position, engage additional stationary arranged plates with suitable recesses for a temporary deflection and/or clamping of the threads, depending on the feed position. The drive of the activation mechanism can be triggered directly via the upper shaft and occur with the cam mechanics on the primary shaft synchronously in reference to the rotary angle of the two shafts.

Alternatively, the drive can be performed by a servomotor or a stepper motor.

BRIEF DESCRIPTION OF THE DRAWINGS

The invention is explained in greater detail using illustrated exemplary embodiments. Shown are.

DETAILED DESCRIPTION OF THE PREFERRED EMBODIMENTS

Figure 1:
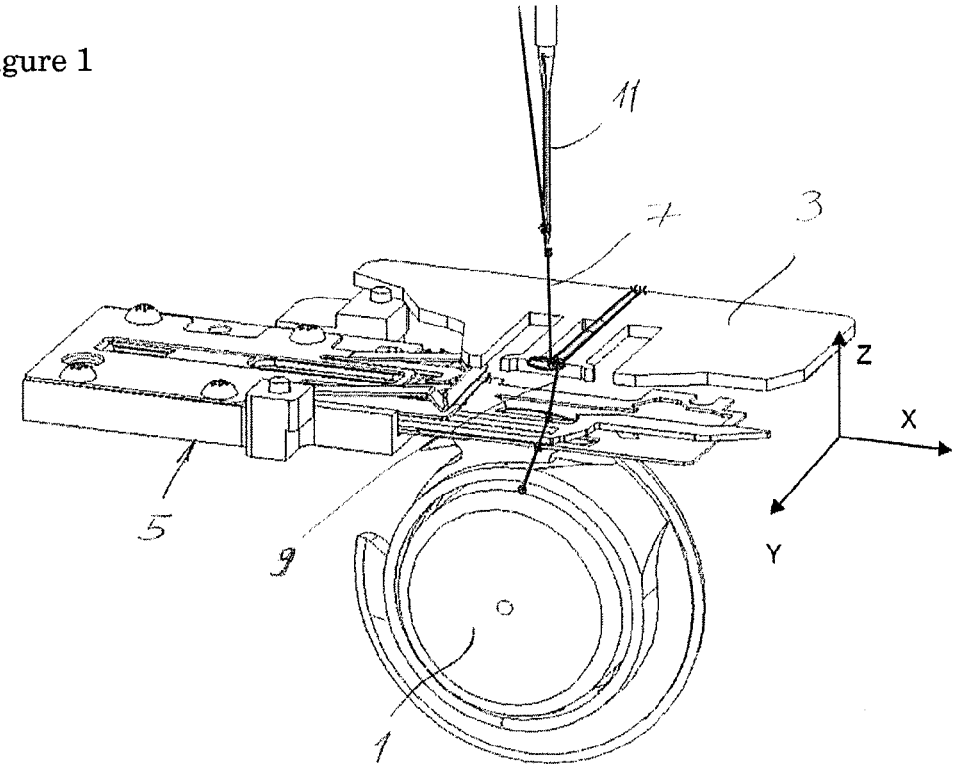
FIG. 1 is a perspective, sectional illustration of the stitching plate and the hook located underneath thereof as well as a thread cutting and lead-in stitching mechanism at the beginning of the first stitch, upper shaft position 220°.
Figure 10:
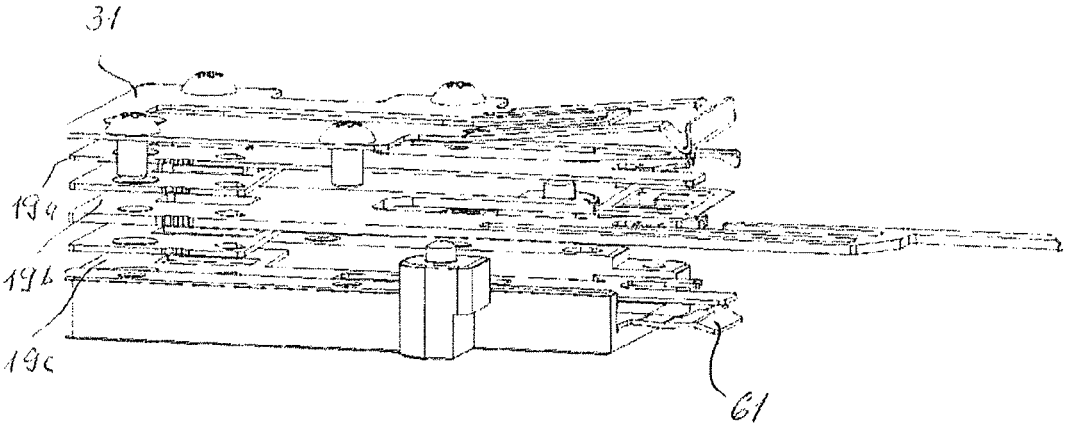
FIG. 10 is a perspective view of the free cutting arrangement, comprising several plates located over top and displaceable in reference to each other.

In the illustration according to FIG. 1 a hook is marked with the reference character 1 and a stitching plate with the reference character 3. A thread cutting and lead-in stitching unit 5 is discernible between the hook 1 and the stitching plate 3. The thread cutting unit 5 comprises a multitude of movable plates, located over top of each other, partially arranged fixed and partially in a manner movable synchronously in reference to each other, serving as thread catchers and thread deflectors and redirectors (in FIG. 10 shown in an exploded illustration). The description and/or functions of the individual plates occur partially in the individual processing steps, shown in the following figures.

Figure 2:
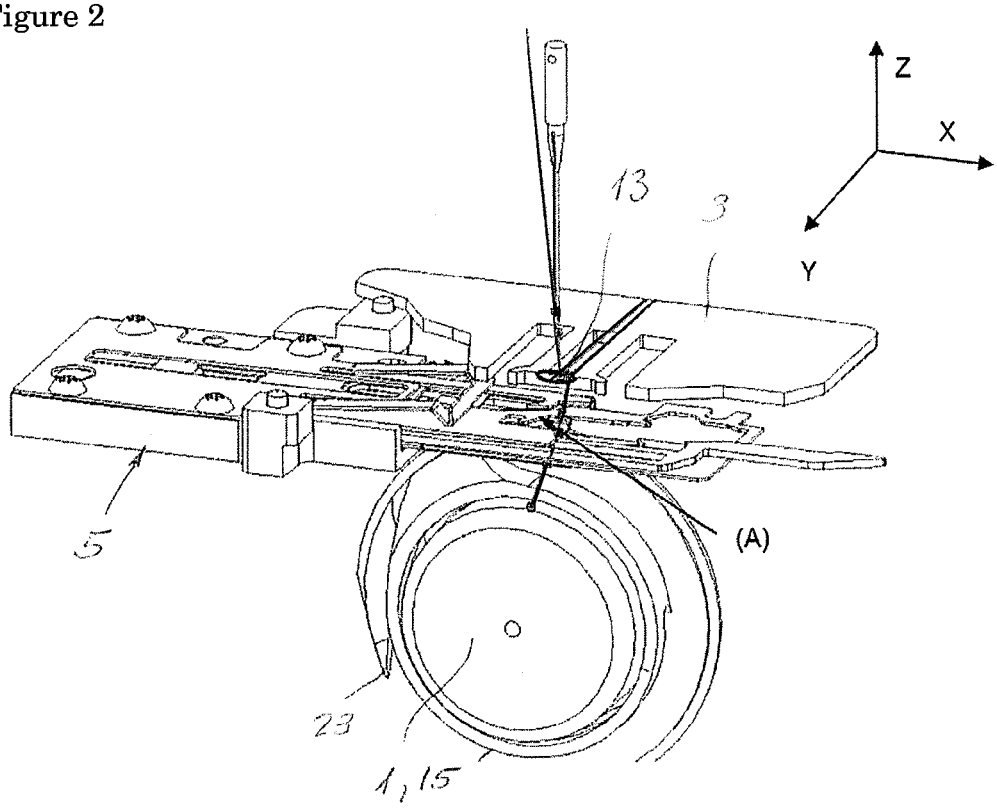
FIG. 2 is a view of an arrangement similar to FIG. 1 after a rotation of the upper shaft by 50°, a thread catcher begins to move in the x-direction and grasps the lower thread with a lower thread-catching edge.
Figure 3:
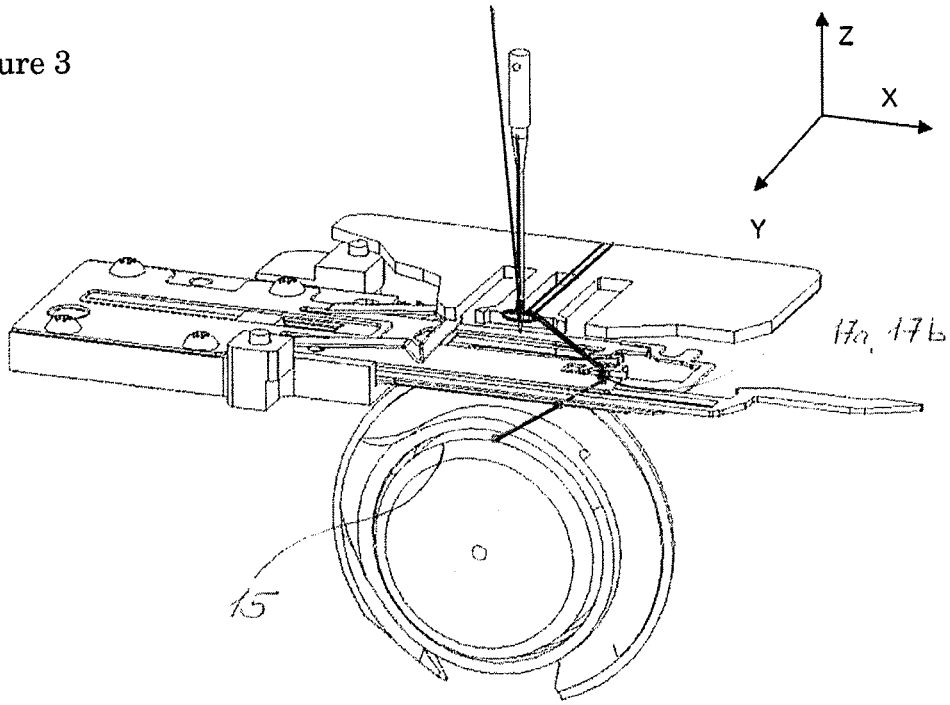
FIG. 3 is a view with a rotary angle of 290°; the lower thread is ejected by the lower thread edge and held in a thread receiver; the needle pierces into the material.
Figure 4:
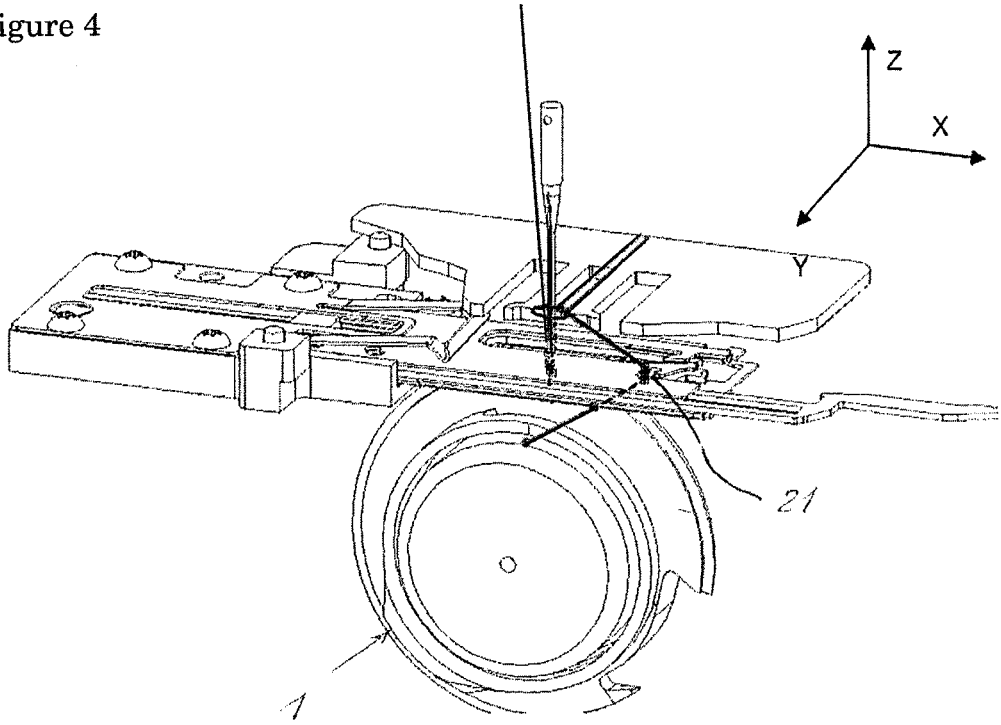
FIG. 4 is a view of the arrangement at 320°, the thread catcher reaches its end position, the lower thread is maximally deflected.

FIG. 1 shows the initial position of the thread cutting unit 5 and none of the plates engages any of the threads (upper thread 7 or lower thread 9). The performance of the last stitch at the end of a sewing or embroidering stitching is described based on FIGS. 1 through 14. It is assumed that the upper thread 7 and the lower thread 9 are essentially located in the position shown in FIG. 1 and form a stitching. At the beginning of the last stitch at an angle of the upper shaft of 220° the last stitch begins and the needle 11 holds the upper thread between the stitching hole 13 stretched essentially in a straight line; the lower thread 9 extends essentially straight from its exit from the bobbin case 15 towards the stitching hole 13. Now a synchronous shifting starts of the three thread catching plates, i.e. the upper, central, and lower thread catchers 19*a*, 19*b*, and 19*c* for short, a thread stretching plate 31, and a clamping plate 61. At an upper shaft angle of 270°, i.e. after a rotation by 50°, the control edges 17*a*, 17*b* engage the upper thread catcher 19*a* and the central thread catcher 19*b*, i.e. the plates of the thread cutting unit 5, the lower thread 9 (FIG. 2 and FIG. 33*c*). After another angular rotation of 20°, i.e. at an angle of the upper shaft of 290°, using their control and separating edges 17*a*, 17*b*, the upper thread catcher 19*a* and the central thread catcher 19*b* have deflected the lower thread 9 after ejection towards the right in FIG. 3 and in detail in the FIGS. 33*d* and 33*e*. In these positions the lower thread 9 is ejected from the control edges 17*a*, 17*b* and glides into a thread receiver 21 in a stationary thread guiding plate 33.

Figure 5:
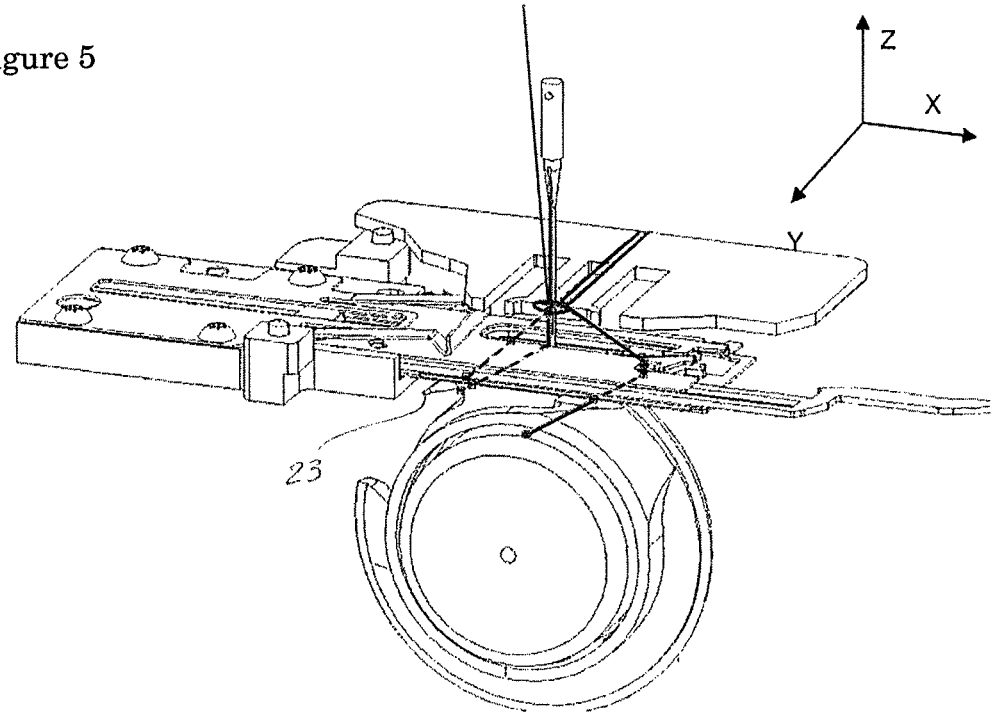
FIG. 5 is a view of the arrangement after a rotation of 190° at 50°, the hook tip engages the upper thread.
Figure 6:
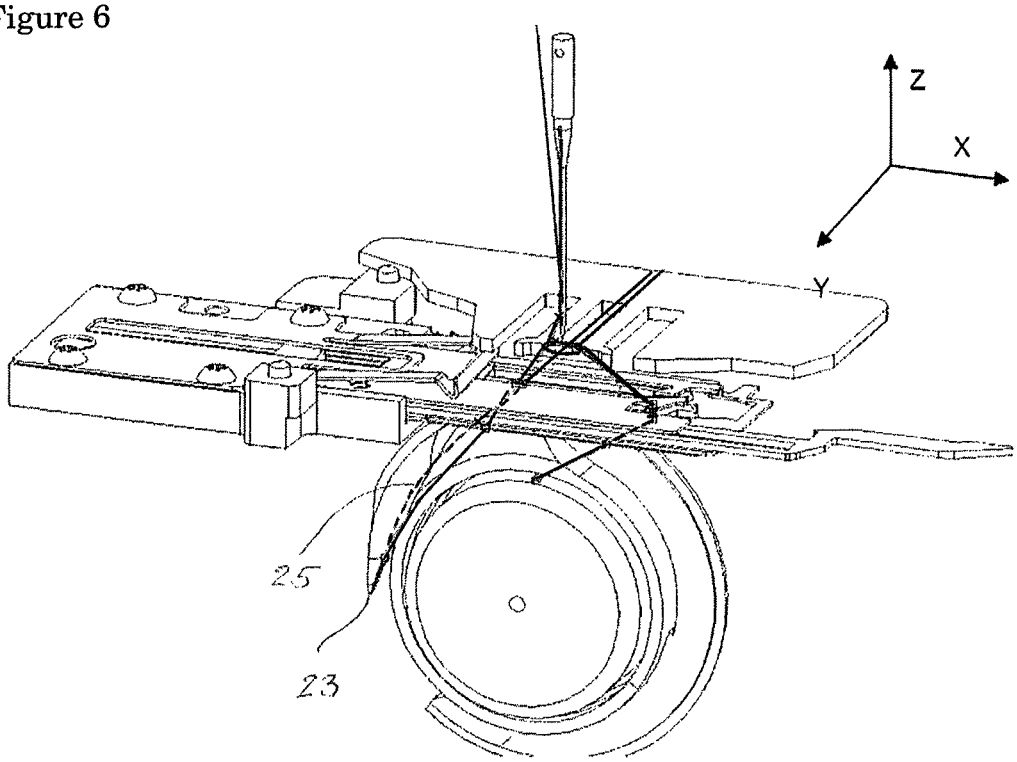
FIG. 6 is a view of the needle thread and the material thread being spread (80°)
Figure 7:
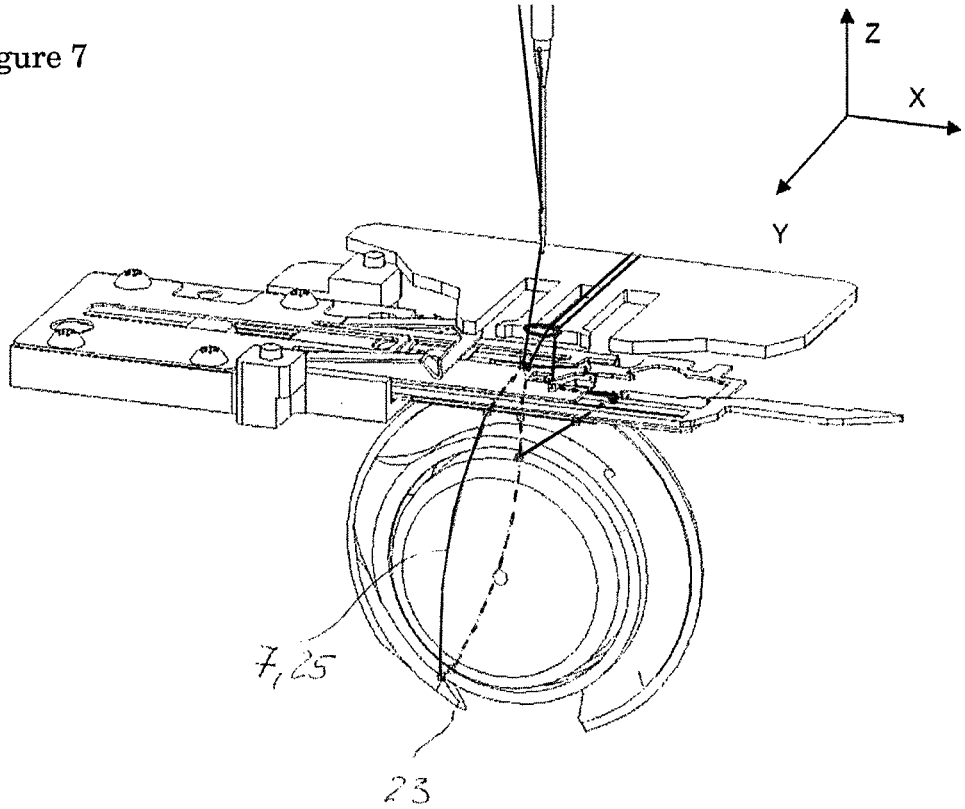
FIG. 7 is a view at 110°, the needle and material thread are maximally spread, the thread catcher begins to move in the x-direction.

At an upper shaft angle of 320° the tip of the needle 11 has crossed the stitching plate 3 and after another 50° the hook tip 23 has engaged the upper thread loop 25 and deflected the upper thread 7 towards the left between the stitching hole 13 and the hook tip 23 (FIG. 5). After another 30°, i.e. at an angle of the upper shaft of 80° the needle 7 has already left the stitching plate 3 towards the top and the upper thread loop 25 is further spread apart by the edges 17*e* and 17*d* of the thread catcher 19*a* and 19*b*. After another 30°, i.e. at an angle of the upper shaft of 110°, the upper thread loop 25 is spread almost completely. The needle thread 7*a* is engaged by the edge 17*c*. Simultaneously the upper and the central thread catchers 19*a* and 19*b* pull the lower thread 9 between the stitching hole 13 and the thread receiver 21 towards the left, so that it extends between the stitching hole 13 and the thread catcher 19*a* approximately in the direction of the needle 11 (FIG. 7).

Figure 8:
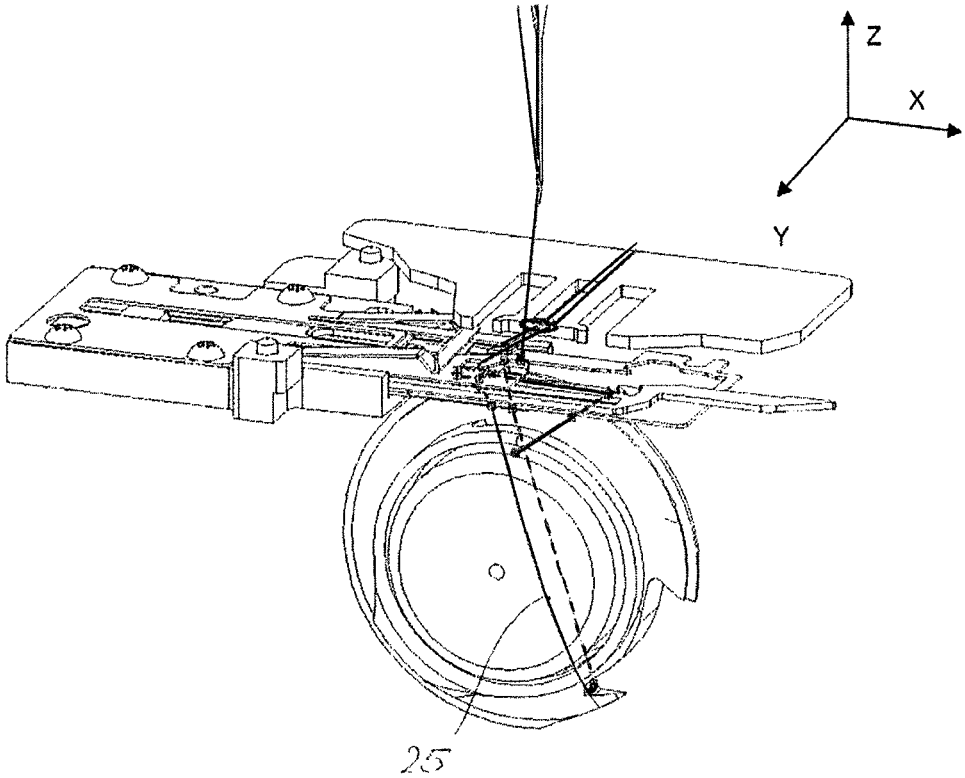
FIG. 8 is a view of the arrangement at 140°, the thread catcher engages the needle and the material threads with separate catching contours.
Figure 34:
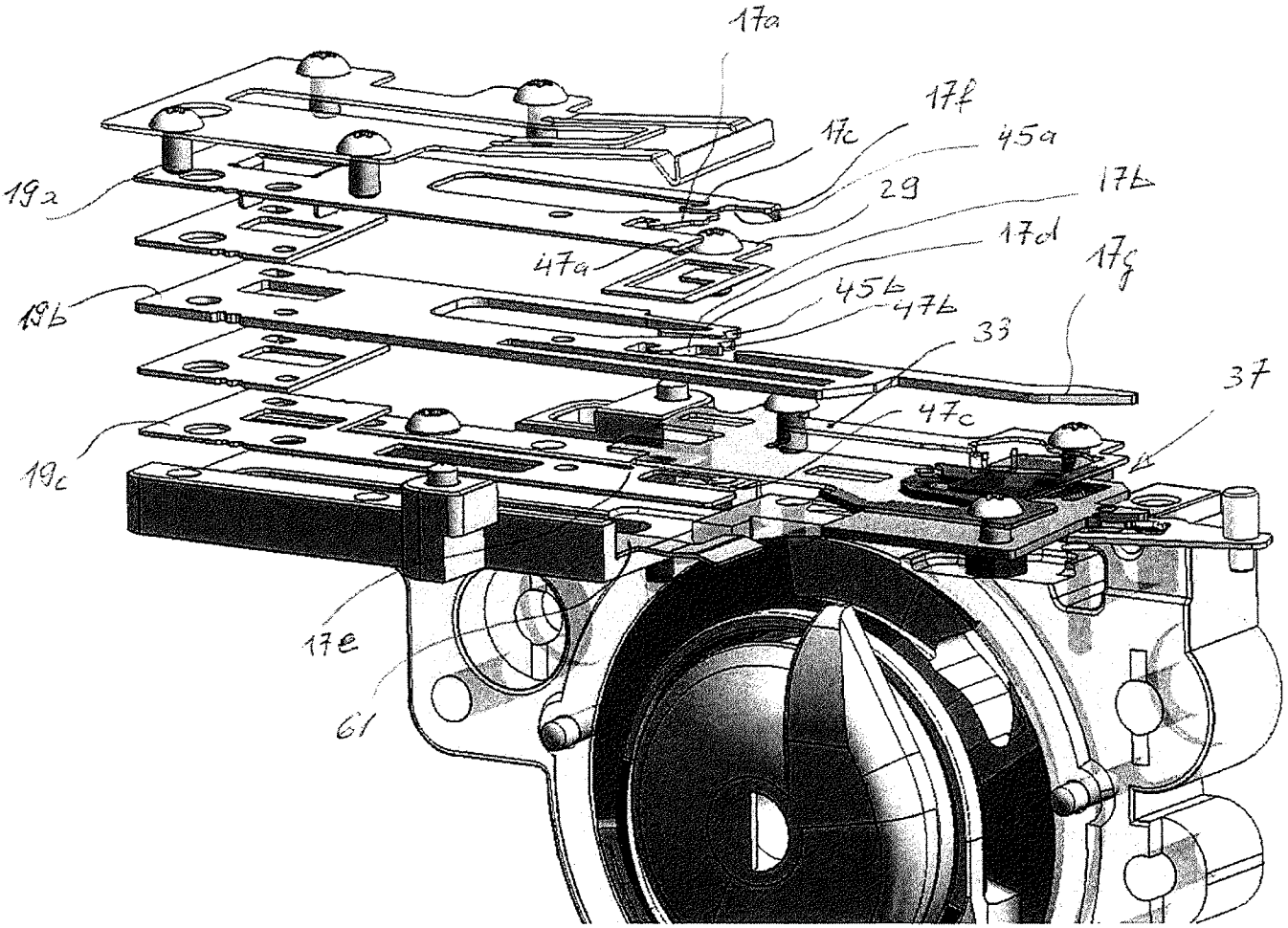
FIG. 34 is an exploded illustration of the thread cutting and lead-in stitching device.
Figure 34A:
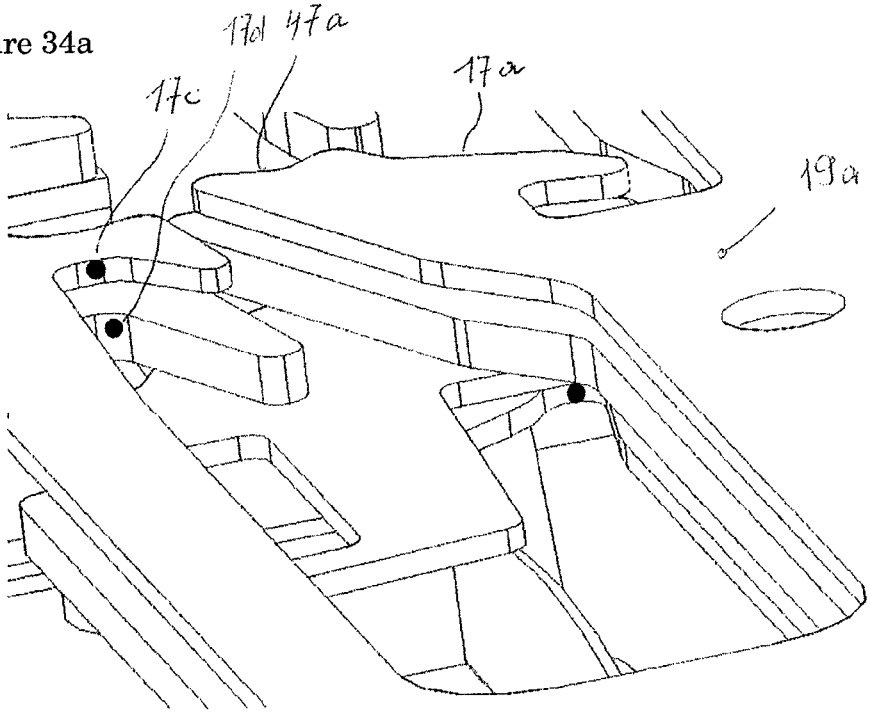
FIG. 34*a* is a view showing one situation of the thread position.
Figure 34B:
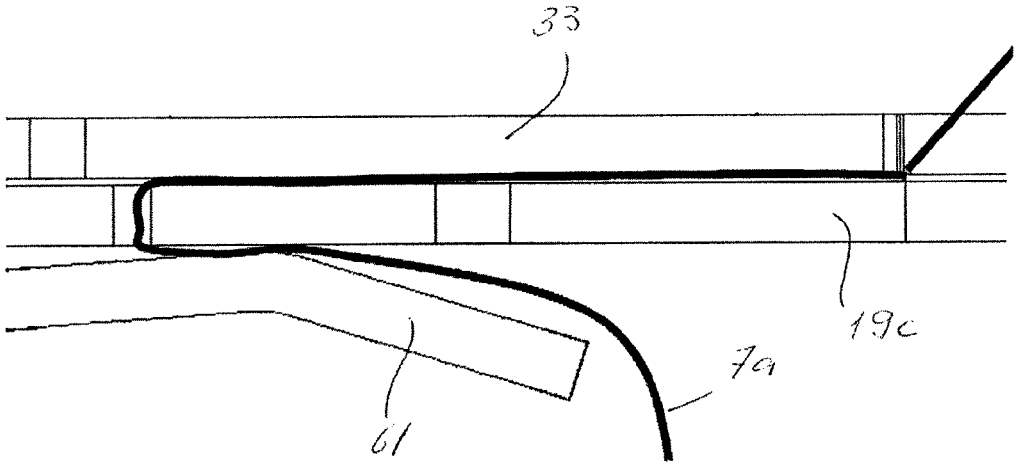

In FIG. 8 the upper thread loop 25 has passed below the nadir of the hook 1 and is located in the ejection position. The lower thread 9 is deflected further to the left by the continued retracting thread catchers 19*a*, 19*b* and now extends above the upper thread catcher 19*a* at an acute angle in reference to the stitching hole 13. Simultaneously the needle thread 7*a* is braked and/or decoupled (FIG. 34*d*) and the thread tension (tensile organ not shown) is opened so that the needle thread 7*a* can be pulled forward by the thread lever out of the thread bobbin to the required length (FIG. 8).

Figure 9:
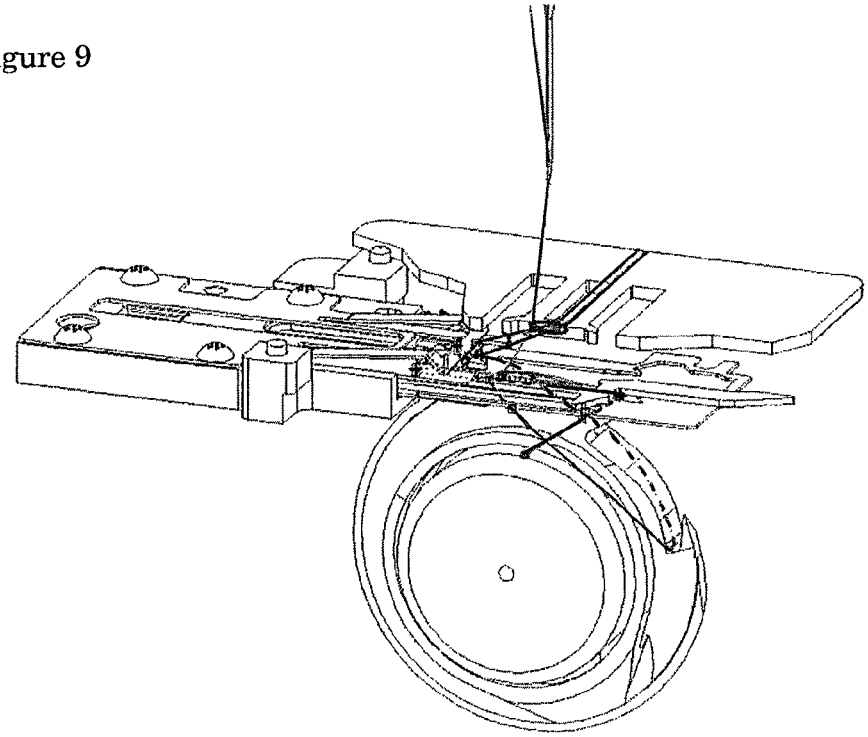
FIG. 9 is a view at 175°, the needle thread is pulled forward by the thread lever into the required length and the upper thread and the lower thread are in a position shortly before being severed.

At an angle of the upper shaft of 175° the material thread 7*b* of the upper thread 7 and the lower thread 9 are cut and/or severed (FIG. 9).

Figure 11:
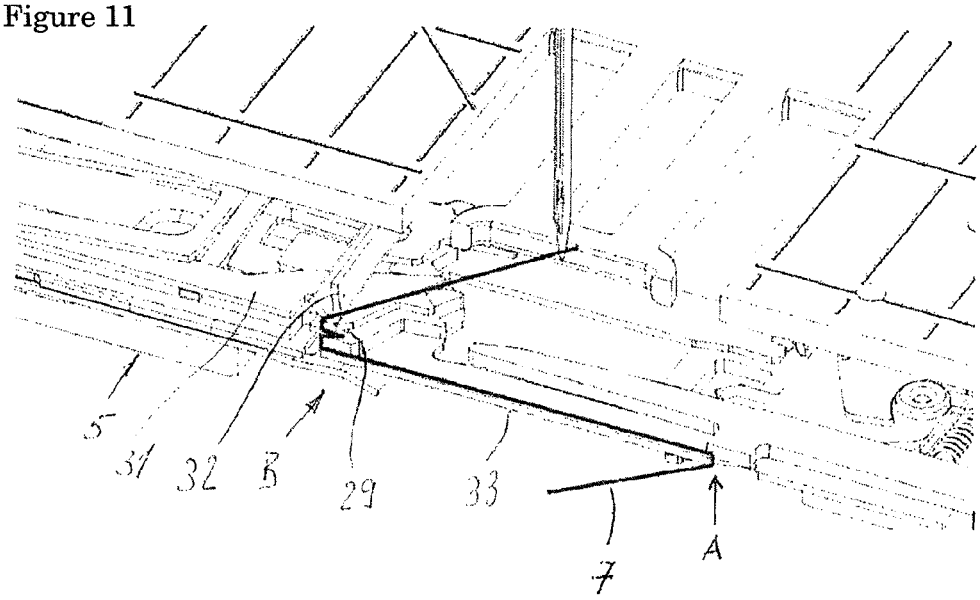
FIG. 11 is an enlarged perspective view of the cutting device in FIG. 10 in the severing moment (the lower thread is shown)
Figure 12:
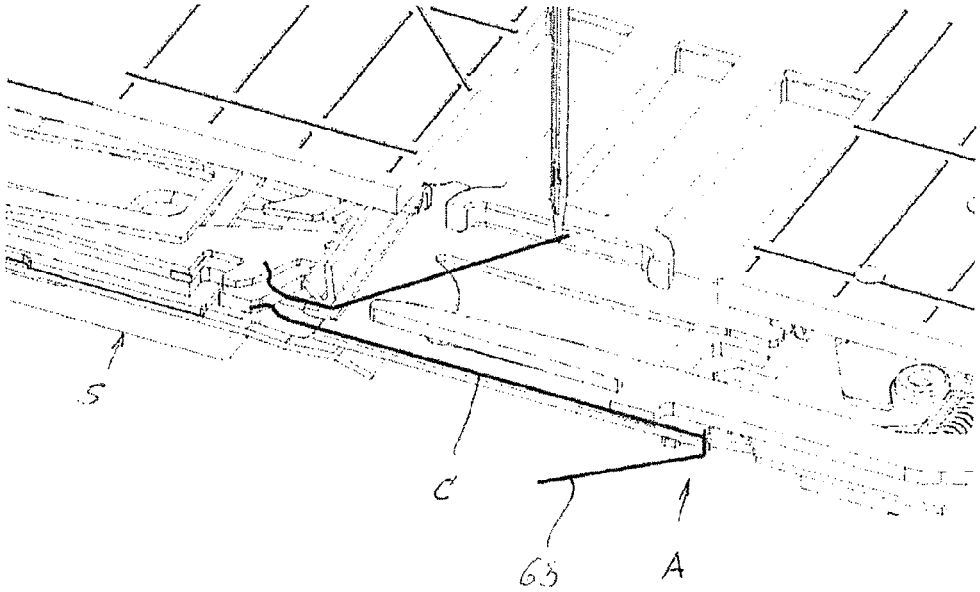
FIG. 12 is a view similar to FIG. 11, immediately after cutting.
Figure 13:
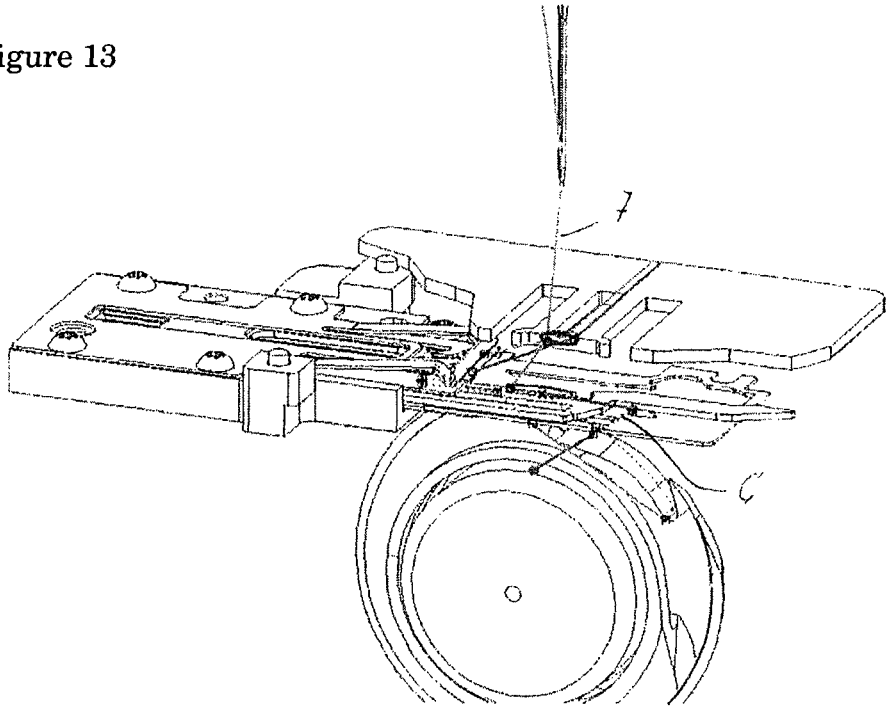
FIG. 13 is a view at 185°, the thread catcher reaches its initial position, the upper thread is pulled by the thread lever out of the thread catching mechanism, the lower thread is located in a defined position on the thread guiding plate and is here held in its position.

The cutting occurs as shown in FIG. 11 for the lower thread 9 by the lower and the upper thread 7 being held at the position A in the thread guide plate 33 and is pulled at the position B over a fixed arranged blade 29 and cut. Using the spring blade 31 the lower thread 9 is braked before it is cut. Prior thereto, the steps occurred that at an angle of the upper shaft of approximately 175° the upper thread 7 to be cut was pulled towards the blade 29 by the edges 17*a*, 17*b*, 17*c* at the thread catchers 19*a*, 19*b*, 19*c*, i.e. towards the left, to reach the required length (FIG. 11). This (occurs) without any increase in tension upon the upper thread 7 in order to avoid negatively influencing the already sewn seam. Shortly before the stationary fastened blade 29 is reached, a thread tension is impinged locally upon the thread 7 to be cut by the spring blade 31 at the thread cutting unit 5 (see FIGS. 10 and 34), its frontal edge 32 acting as the spring. Now, the upper thread 7 and the lower thread 9 can be pulled as "stationary loops" through the blade 29 and securely cut here (FIG. 12).

After another rotation of the upper shaft to an angle of 185° the thread catchers 19 have reached their initial position. The upper thread 7 is pulled by the thread lever (not shown) out of the thread catchers 19. Now the lower thread 9 is located in the defined position C (FIG. 12) on the thread guide plate 33 and is held here in its position.

Figure 14:
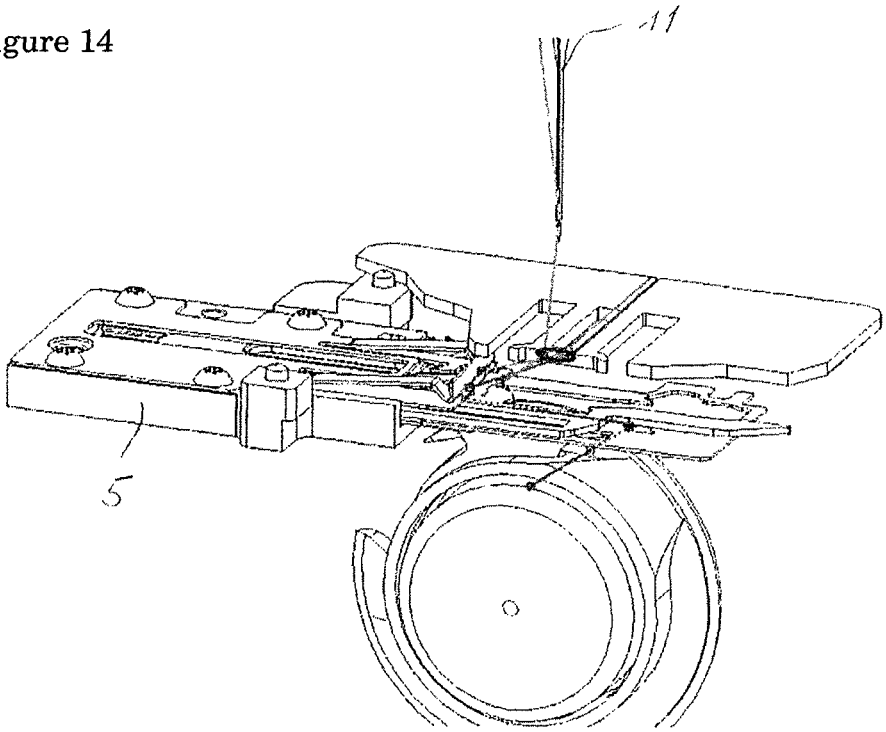
FIG. 14 is a view at 220°, the first cycle is concluded, at least one upper and the lower thread are separated and pulled forward to the required length, ready for stitching or lead-in embroidering, the machine stops, a new work piece can be inserted.

At an angle of the upper shaft of 220° the cycle is concluded. The sewing foot (not shown) is raised and the material to be sewn (not shown) can be removed. The upper thread 7 and the lower thread 9 are separated from the material and pulled forward to the required length (FIG. 14).

Contrary to the angle of the upper shaft of 220° at the beginning of the last stitch at the end of a seam now the upper thread 7 and the lower thread 9 are no longer stretched from the needle 11 to the stitching hole 13 and/or from the bobbin case 15 to the stitching hole 13. At least one upper thread 7 is loose and the lower thread 9 is positioned by the thread cutting unit 5. They are now located in an optimal starting position for the lead-in embroidering and/or sewing of a new seam.

Figure 15:
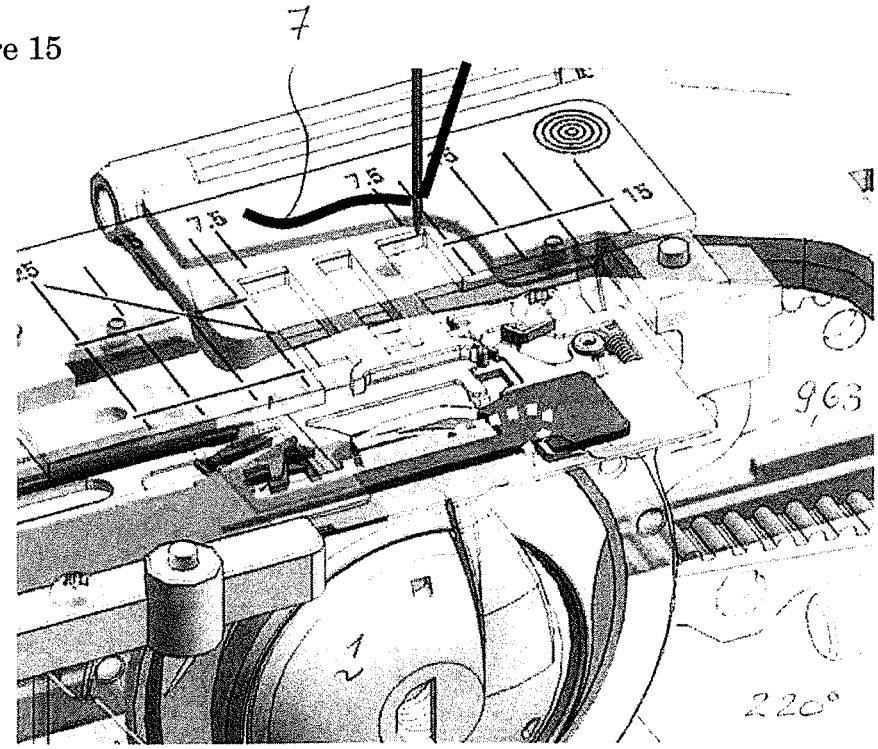
FIG. 15 is a view as the machine begins to generate the first stitch at an upper shaft angle of 220°.
Figure 16:
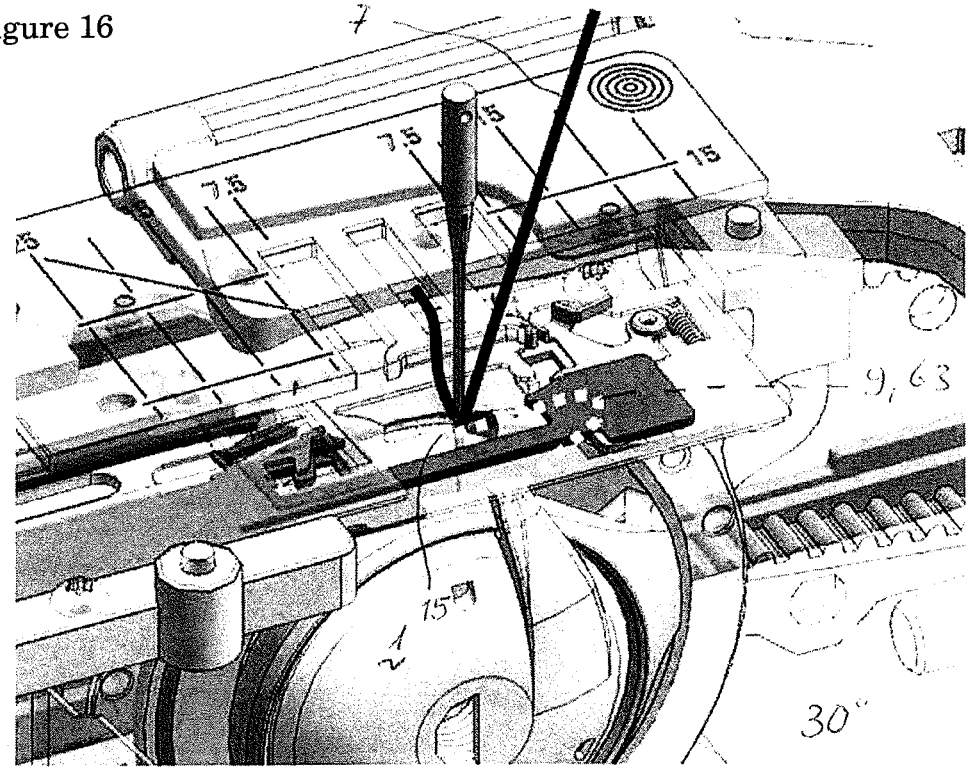
FIG. 16 is a view at 30°, the upper thread-loop has been created and the hook engages the upper thread-loop.
Figure 17:
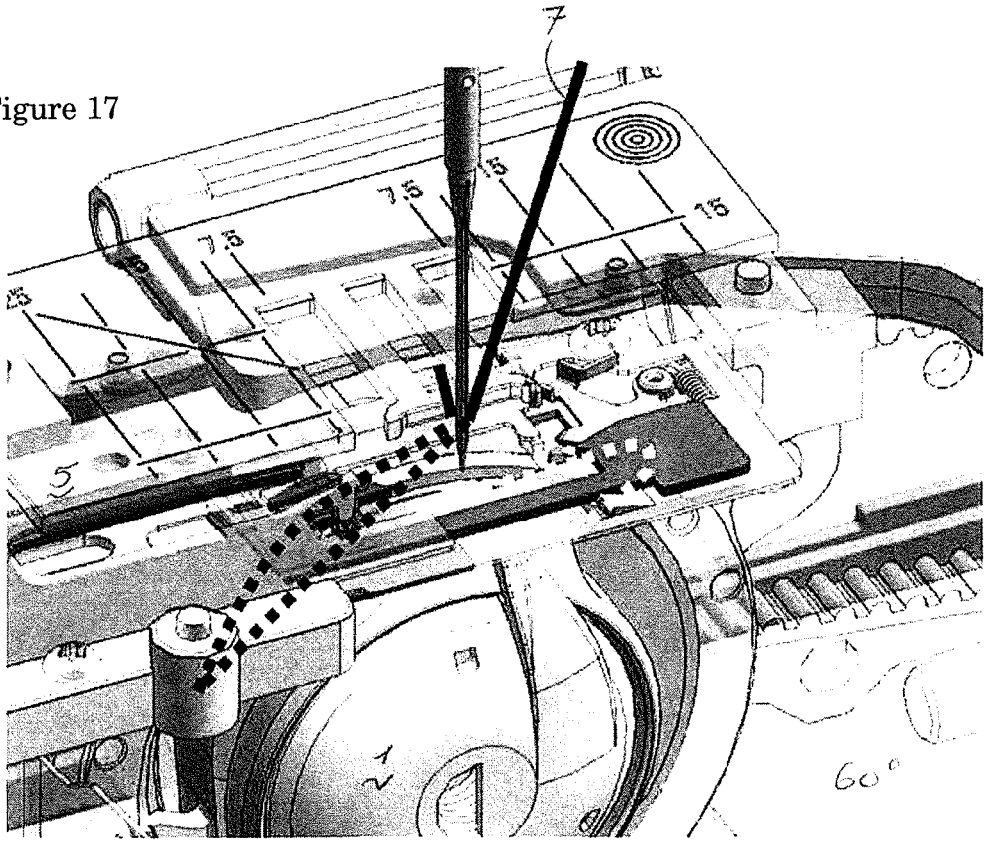
FIG. 17 is a view at 60°, the thread catcher beings to shift towards the right.
Figure 18:
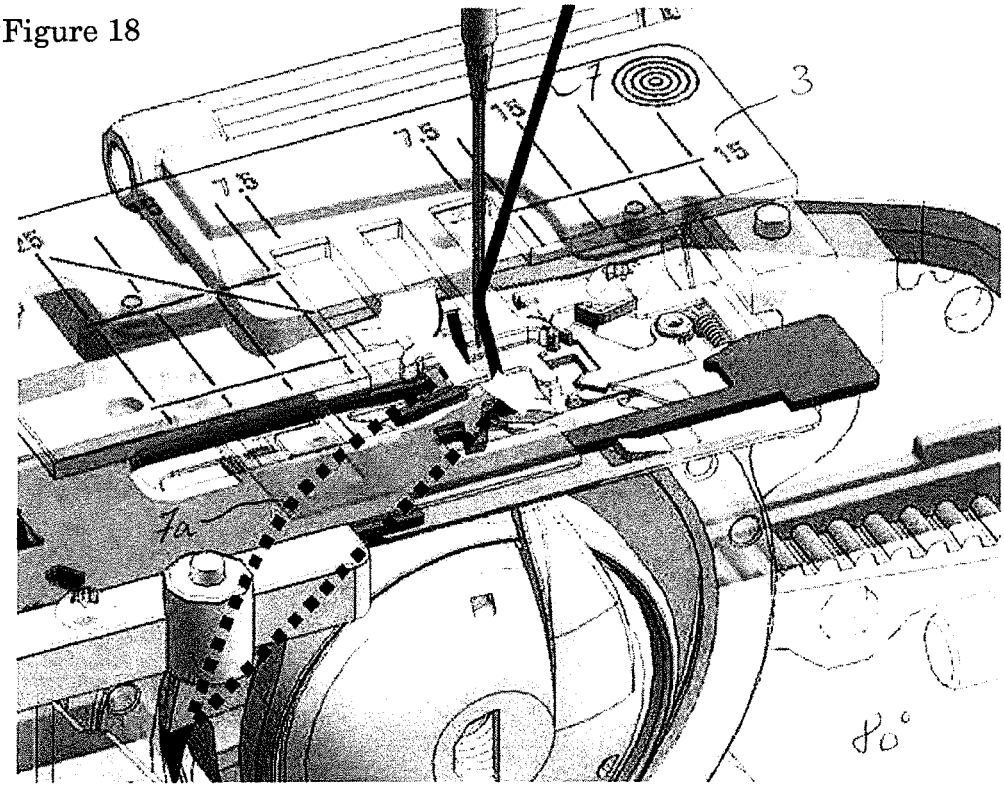
FIG. 18 is a view at 80°, the upper thread-loop engages the material thread as well as the needle thread at the thread catcher in the recesses arranged appropriately.
Figure 19:
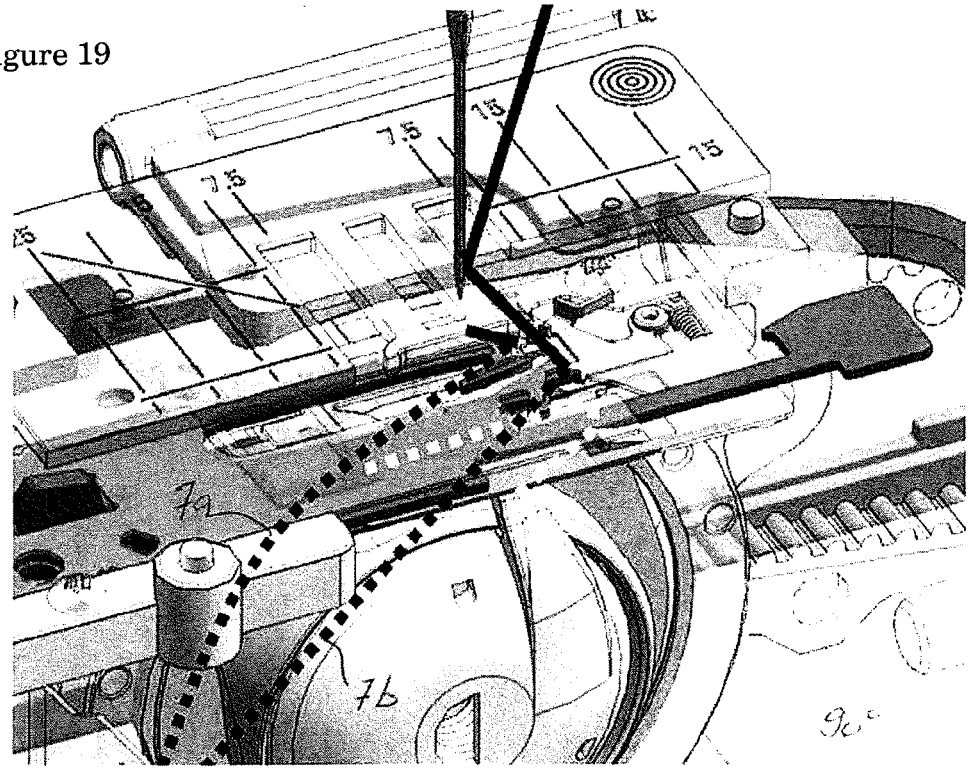
FIG. 19 is a view at 90°, the material thread has been pulled by the thread catcher under the stitching plate.
Figure 20:
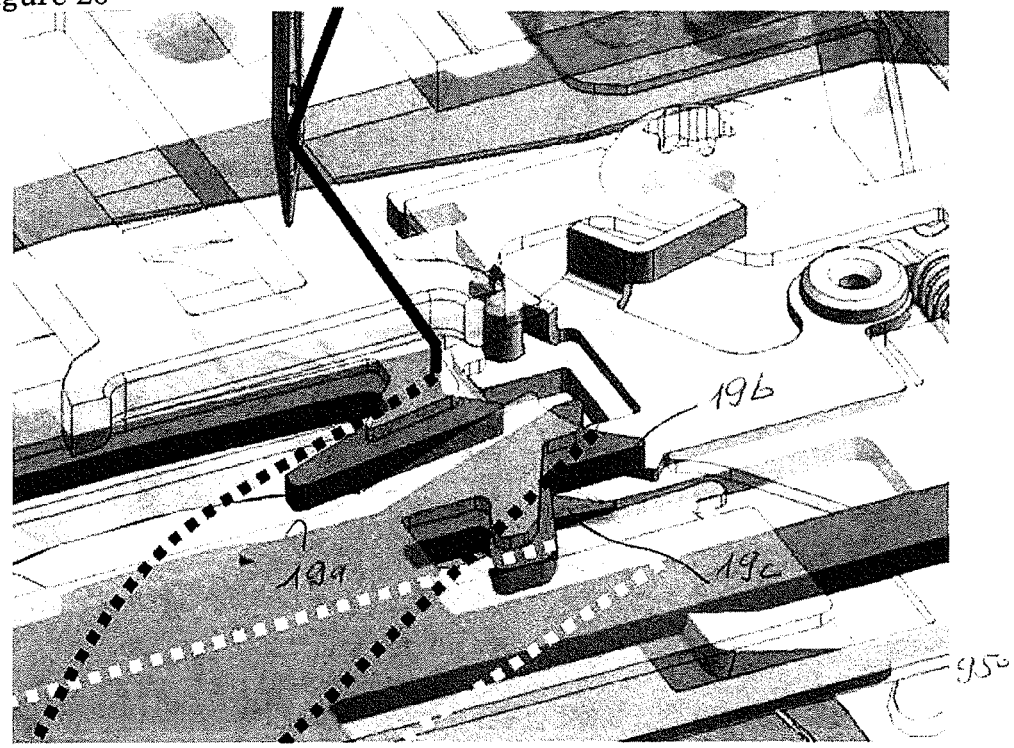
FIG. 20 is an enlarged section view from FIG. 19.
Figure 21:
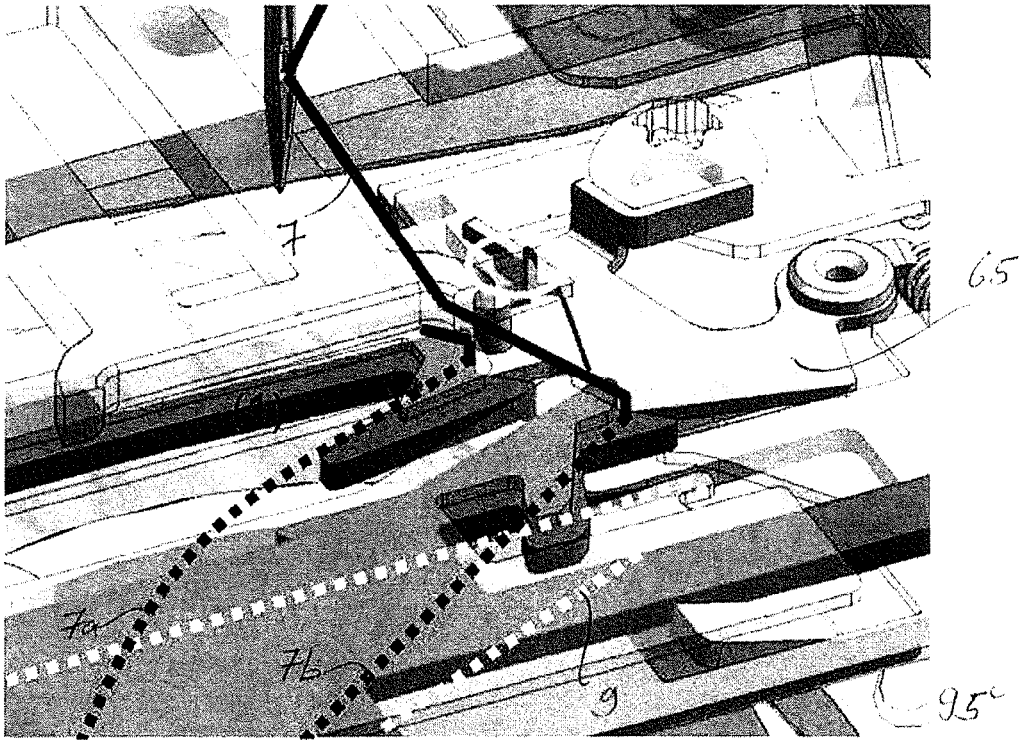
FIG. 21 is a view at 95°, the thread braking plate is opened by the thread catching unit at the site marked A and the thread wiper is operated by the central thread catcher.
Figure 22:
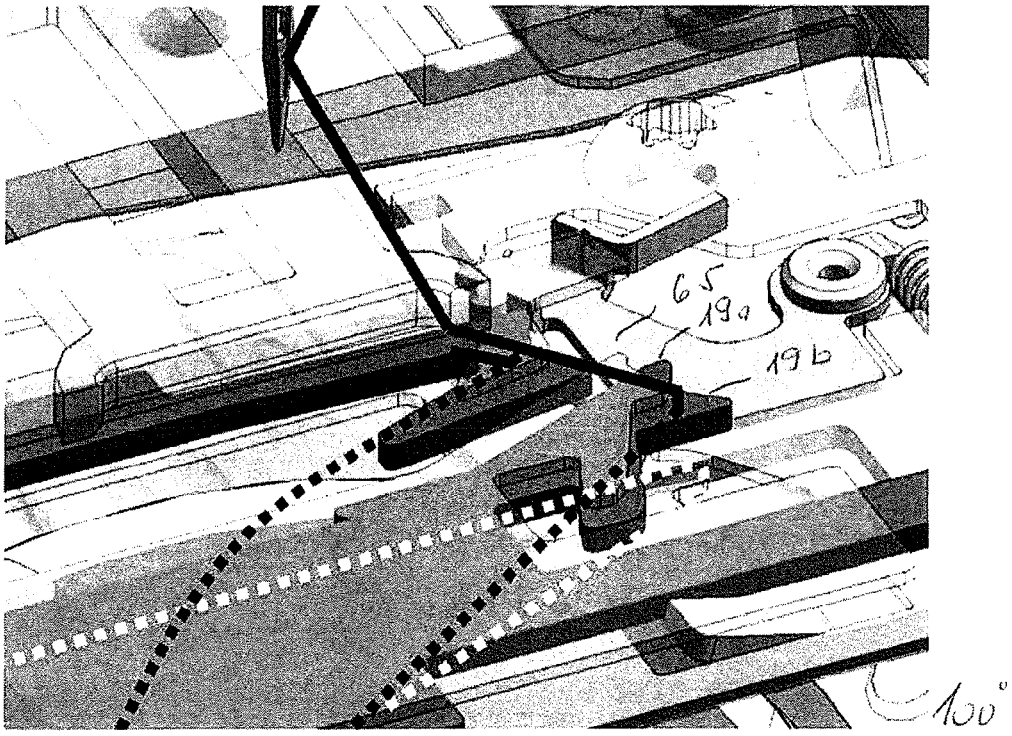
FIG. 22 is a view at 100°, the thread brake plate briefly closes (the threads are located equivalent to the arrangement in FIG. 21)
Figure 23:
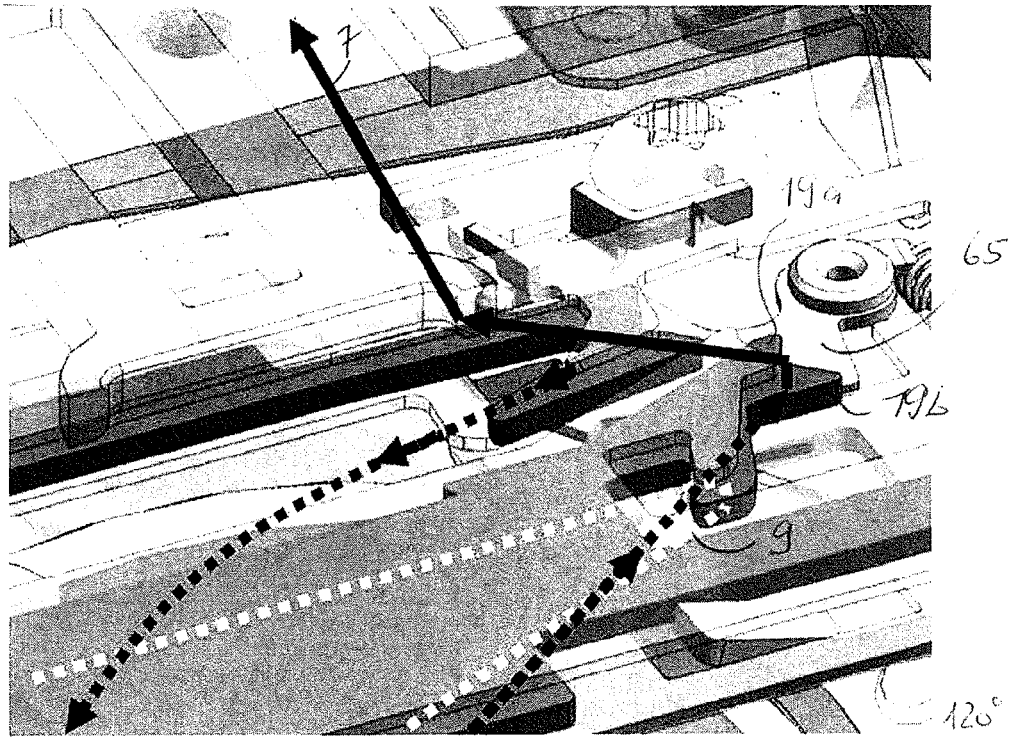
FIG. 23 is a view at 120°, the thread lever reaches the end position and pulls the existing thread through the opened low-friction thread braking plate to the desired length, the first stitch is completed.
Figure 35:
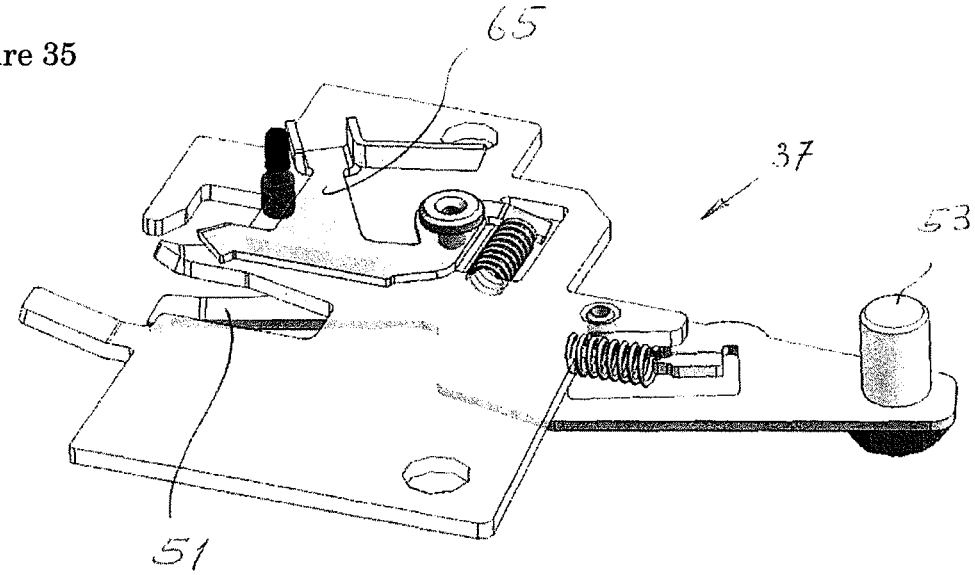
FIG. 35 is a perspective view of the thread wiper and thread braking unit.

Through the use of the thread cutting and lead-in stitching unit 5 both the upper thread 7 as well as the lower thread 9 are located at the end of a sewing or embroidering seam in an optimal position for lead-in stitching (cf. FIG. 15) a new lead-in embroidering or sewing occurs at an angle of the upper shaft of 220°. As discernible from FIGS. 14 and 15 a loop 63 is formed in the lower thread 9, which extends from the exit of the lower thread 9 out of the bobbin case 15 towards the right and therefrom back in the direction towards the stitching hole 13. The loop 63 is now positioned, but not held. After the needle has pierced the material at an angle of the upper shaft of 30° the hook 1 has engaged the upper thread loop; here, the loop 63 of the lower thread 9 has not been changed. At an angle of the upper shaft of 60° (FIG. 17) the upper thread loop is guided counter-clockwise towards the left around the hook 1 and the thread cutting and lead-in stitching unit 5 moves according to a predetermined motion process towards the right, driven by the primary shaft or by a motor. After further rotation of the upper shaft by 20° (FIG. 18) the loose material thread 7*b* of the upper thread 7 is engaged by the recesses 45 and the needle thread 7*a* of the upper thread 7 by respective recesses or slots at the thread catchers 19*a*, 19*b*, 19*c*, with the free end of the material thread 7*b* being pulled underneath the stitching plate 3. FIG. 19 now shows the material thread underneath the stitching plate 3 and in an enlarged illustration in FIG. 20 it is clearly discernible how the material thread 7*b* (top) and the needle thread 7*a* (bottom) are guided at a distance from the lower thread catcher 19*c*. After another rotation of the upper shaft by approx. 5° a thread braking plate 65 (FIG. 35) has been opened by the thread catcher 19 (FIG. 17*f*, FIG. 34) and according to FIG. 22 the thread braking plate 65 briefly closes at an angle of the upper thread of 100°. The position of the threads is unchanged with regards to the angle of the upper thread of 95°.

Figure 25:
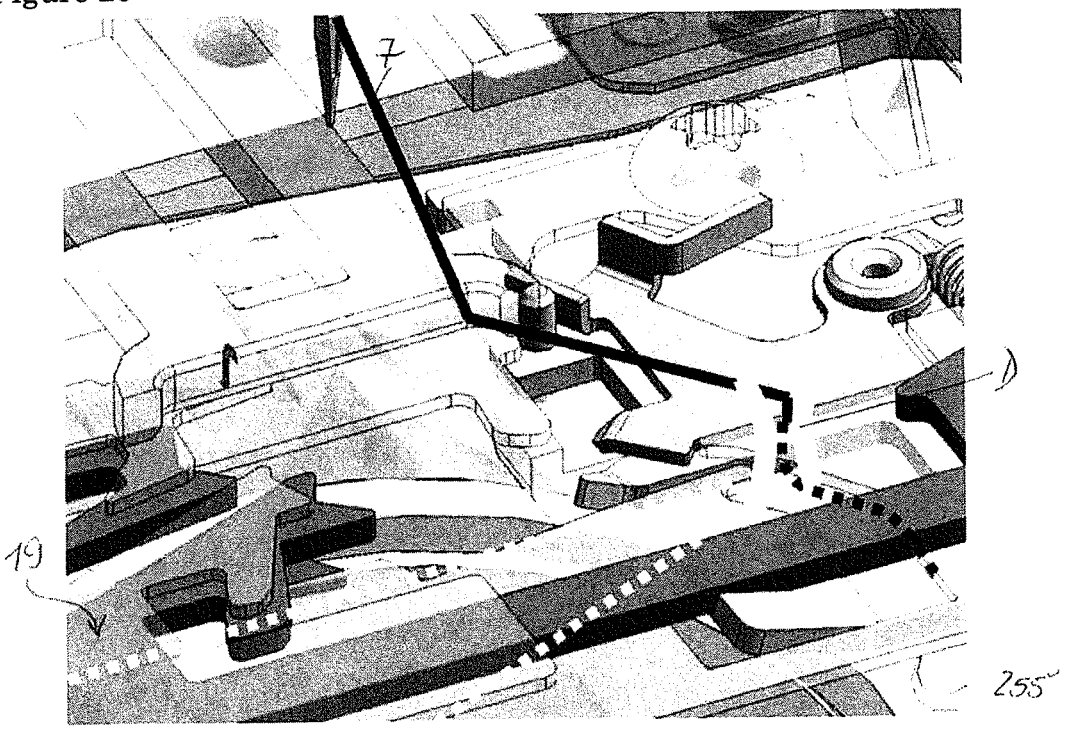
FIG. 25 is a view at 255°, the thread catcher is returned into its initial position and the upper thread is now retained by the thread braking plate with a defined holding force, a tight knot forms, and the thread wiper wipes at least one upper thread and the lower thread into a defined position.
Figure 26:
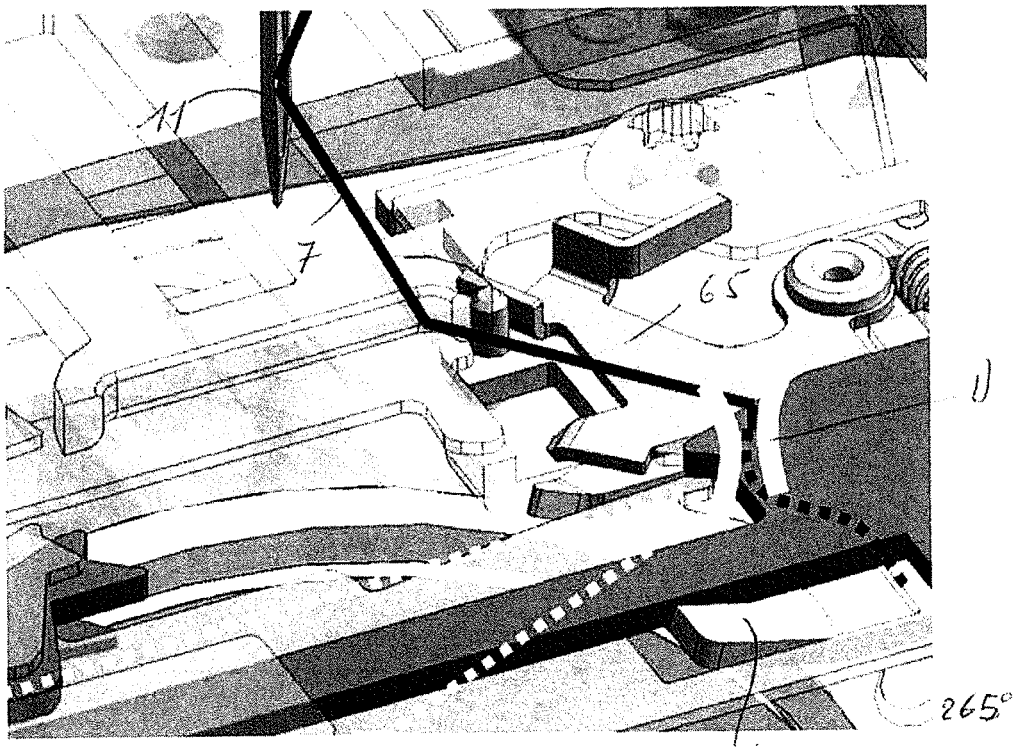
FIG. 26 is a view at 265°, equivalent to an enlarged illustration of a section of FIG. 25.
Figure 27:
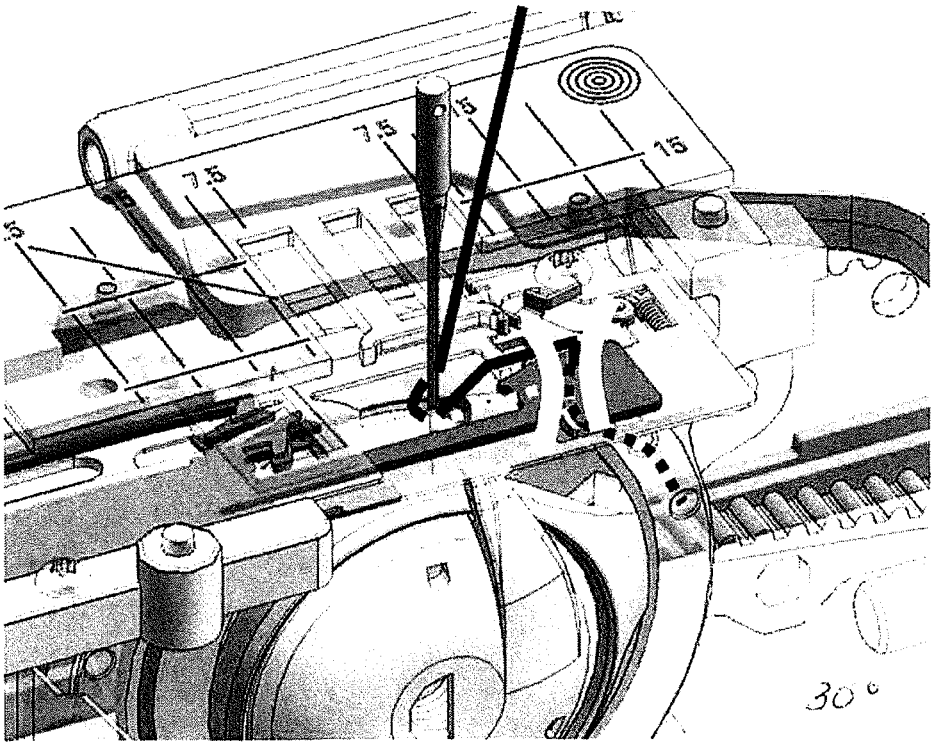
FIG. 27 is a view at 30°, the second stitch is generated.
Figure 28:
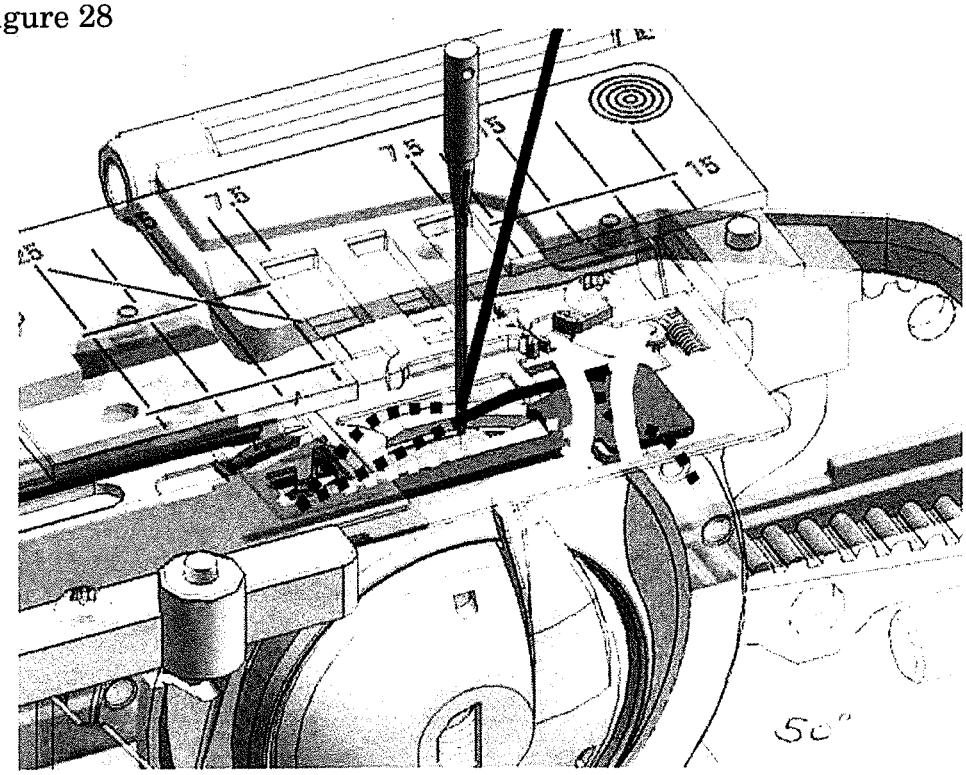
FIG. 28 is a view at 50°, the hook pulls the thread loop away from the needle.
Figure 29:
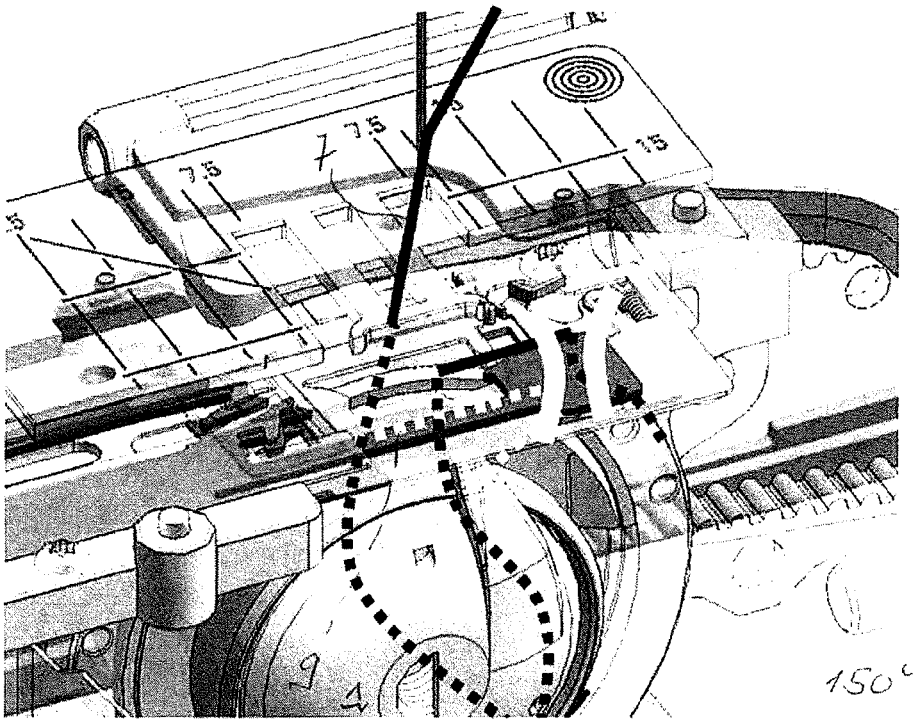
FIG. 29 is a view at 150°, the thread lever pulls back the upper thread.
Figure 30:
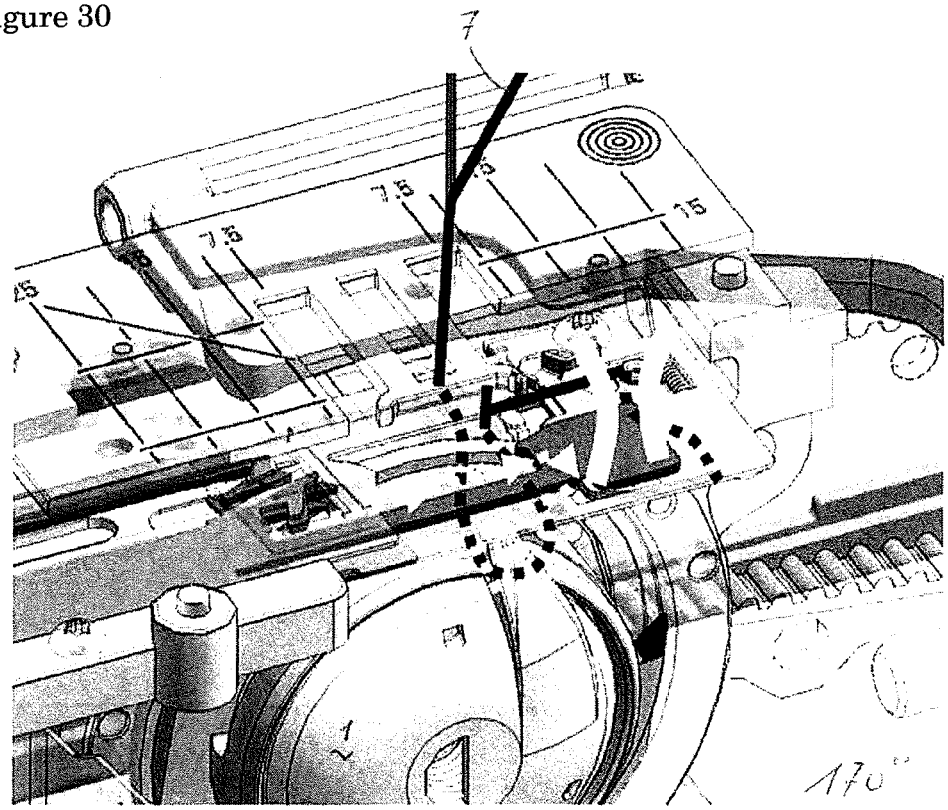
FIG. 30 is a view at 170°, the needle thread is located slightly below the stitching plate.
Figure 31:
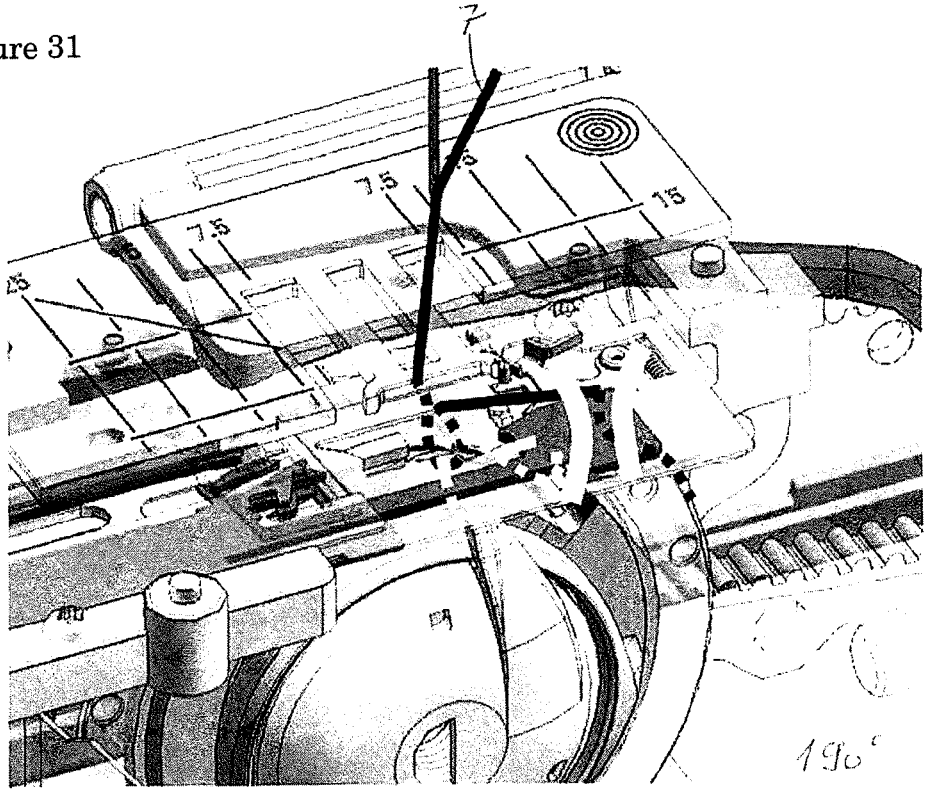
FIG. 31 is a view at 190°, the lower thread is engaged by the upper thread and the thread lever pulls the knot to the underside of the material.
Figure 32:
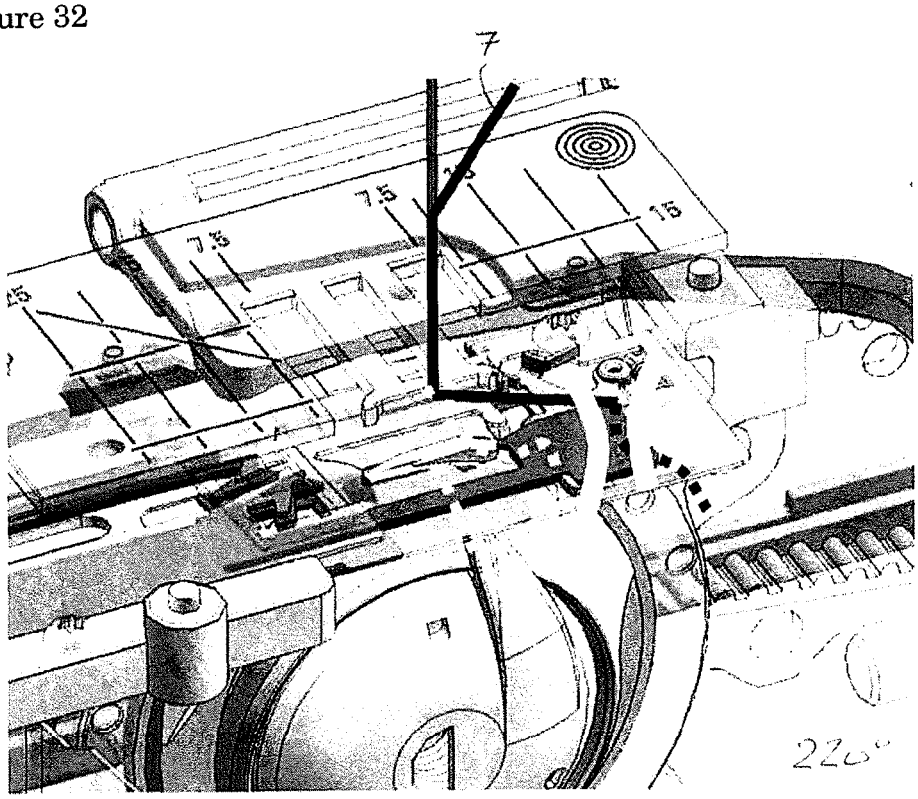
FIG. 32 is a view at 220°, the thread lever has pulled the upper thread-loop with the engaged lower thread to the underside of the material and a tight knot is completed.

At an angle of the upper thread of 120° a temporary end position has been reached and the thread braking plate 65 is opened again. The thread lever pulls the existing upper thread 7 through the opened low-friction thread braking plate to the required length. At an angle of upper shaft of 240°, i.e. after the completion of an entire machine rotation by 360°, the thread braking plate 65 briefly closes. This provides additional important process security because the loose upper thread 7 cannot be entrained by the thread catcher 19 (position D) out of the thread braking plate 65. At 255° the thread catchers 19*a*-19*c* return into the initial position and the upper thread 7 is retained by a defined holding force in order to allow the formation of a tight knot and additionally the loose upper thread loop cannot be pulled through the hole in the material (FIGS. 25 and 26). In FIG. 27 it is discernible how the stitch is generated; this at an angle of the upper shaft of 25°. At an angle of the upper shaft of 50° the hook 1 pulls the upper thread 7 of the following (second) stitch away from the needle 11 (FIG. 28) and at 150° the lower thread 9 is engaged by the upper thread 7 and the thread lever pulls the knot in the direction towards the underside of the material (FIG. 29). After another rotation of the upper shaft by 20° the thread lever has engaged the upper thread loop with the engaged lower thread loop pulled to the underside of the material and the desired tight knot is realized.

At 200° the lead-in stitching function is successfully concluded after two stitches and the next stitches can occur. In turn, FIGS. 33*a* and 33*b* essentially show the thread cutting unit 5, as already shown in FIG. 1, however in an enlarged scale and additionally the wiper unit and the thread braking unit 37 are integrated in addition to the already described thread catchers 19*a*-19*c* and the thread guide plate 33, once more illustrated in FIG. 35 in an enlarge fashion.

In FIGS. 33*c, d*, and *e* it is shown enlarged how the thread reaches the thread receiver 21. The reference character 45*a* marks a thread contour at the thread catcher 19*a* and the contour 45*b* at the thread catchers 19*b* is not active in FIG. 33. However, according to FIG. 33*e* the thread is guided from the two v-shaped contours 47*a* and 47*b* at the frontal ends of the thread catchers 19*a* and 19*b* via the contour 47*c* at the thread catcher 19*c* into the thread receiver 21. All transfers of the thread occur by the displacement of the elements 19*a*-19*c* as well as 31 and 61 of the thread cutting unit 5 in reference to the elements of the wiper and thread braking unit 37 arranged fixed at the sewing machine. Only a linear displacement according to a predetermined speed progression occurs. Only the wiper and thread braking unit 37, with the wiper lever 51 and the thread braking plate mounted thereat, performs a motion laterally extending in reference to the direction of feed of the thread cutting unit 5, which is triggered by the guiding edge 17*g* at the central thread catching plate 19*b*. The wiper unit 37 is locally fixed arranged in the lower arm of the sewing machine. Two pivotal and spring-loaded levers are arranged on the wiper and thread braking unit 37, namely the thread braking plate 65 and a wiper lever 51. For this purpose, the two-arm wiper lever 51 carries on the first of its arms a pin 53 located parallel in reference to the rotary axis of the wiper lever 51, which is pushed laterally by the lower thread catcher 19*c* (contour 17*f*). When pivoting the wiper lever 51 the cut-off ends of the threads are pushed sideways and then rest in an optimal lead-in embroidering and/or sewing position.

Figure 33A:
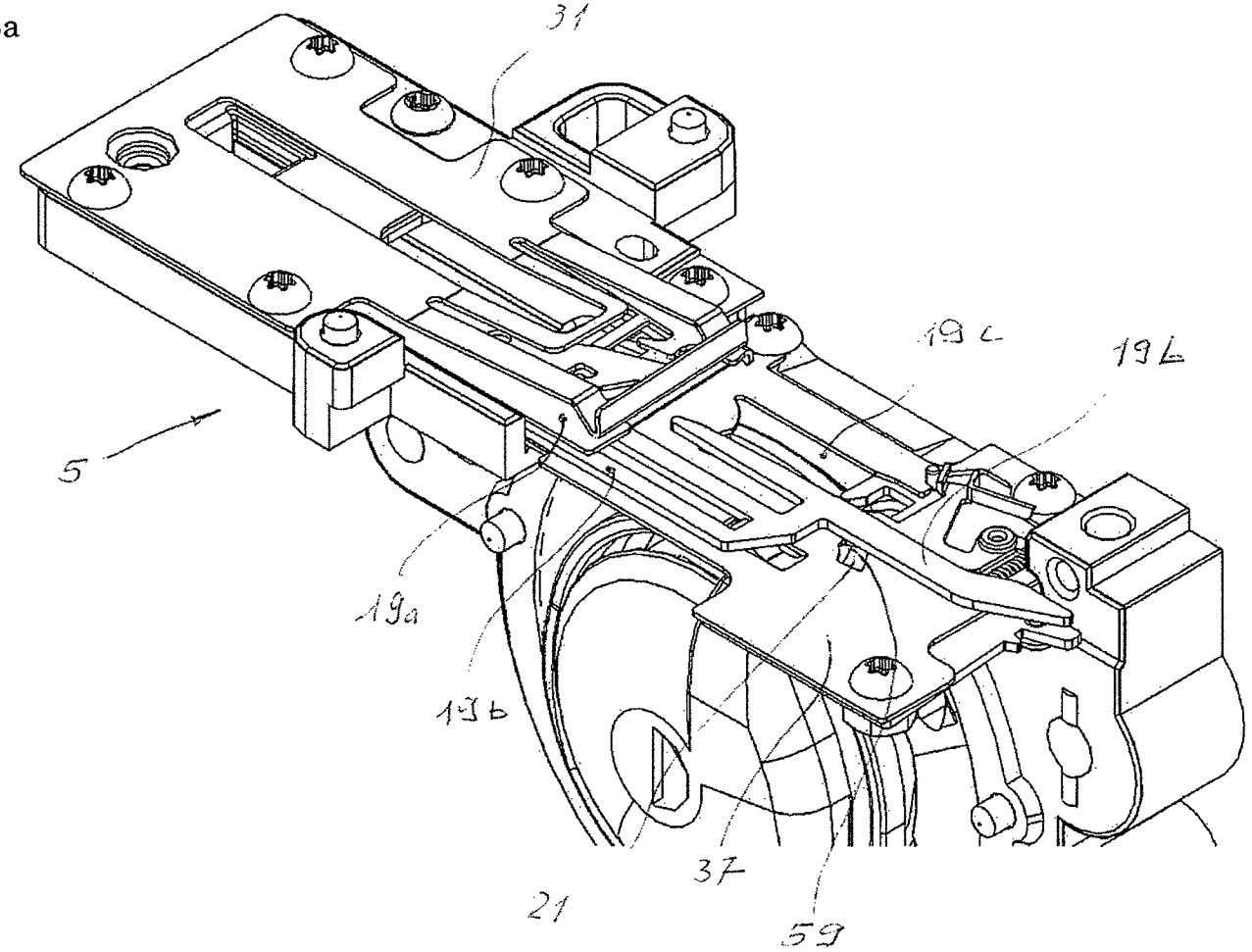
FIG. 33*a* is an enlarged view of the thread cutting and lead-in stitching unit in the initial position.
Figure 33B:
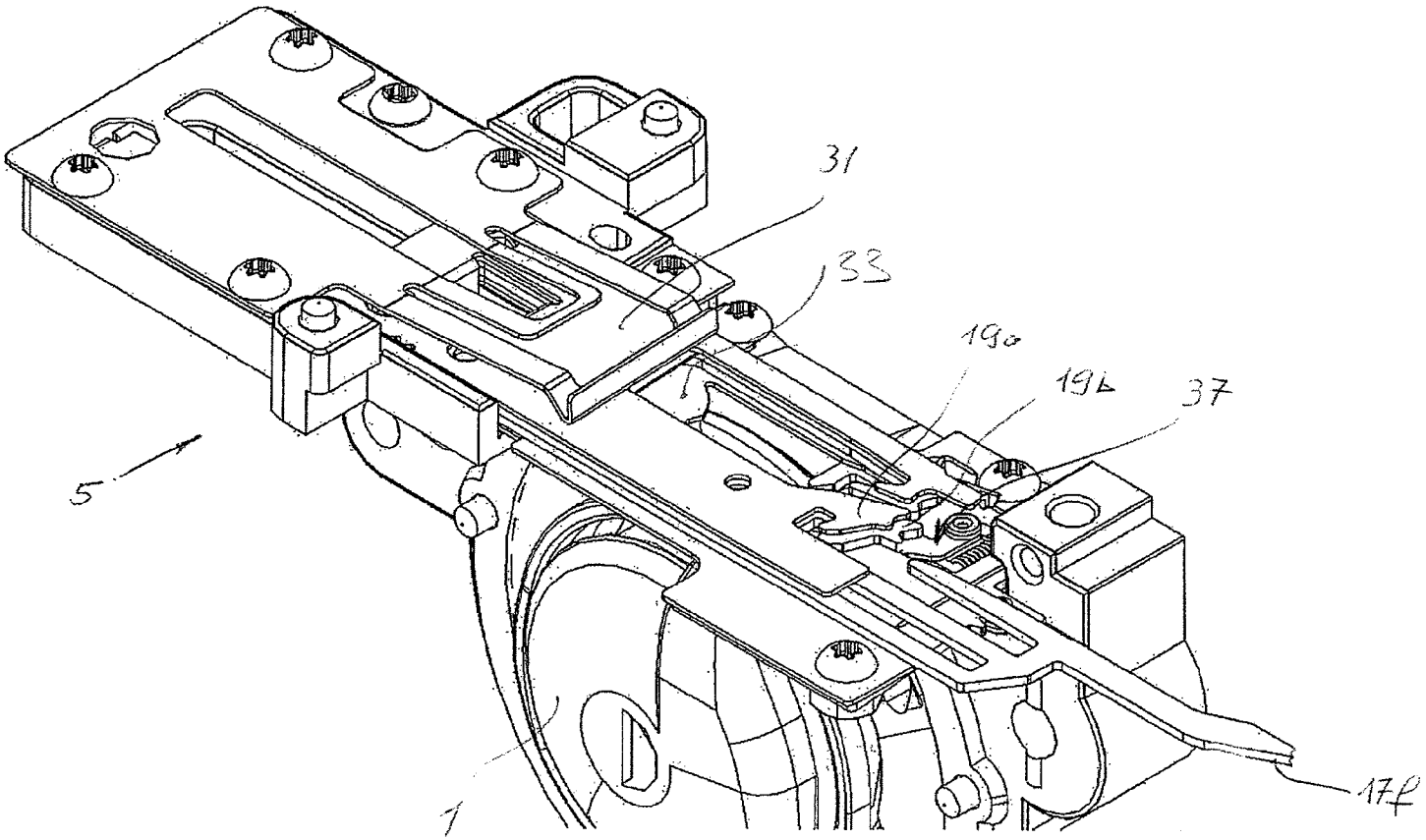
FIG. 33*b* is an enlarged view of the thread cutting and lead-in stitching unit in the initial position, however in the end position.
Figure 33C:
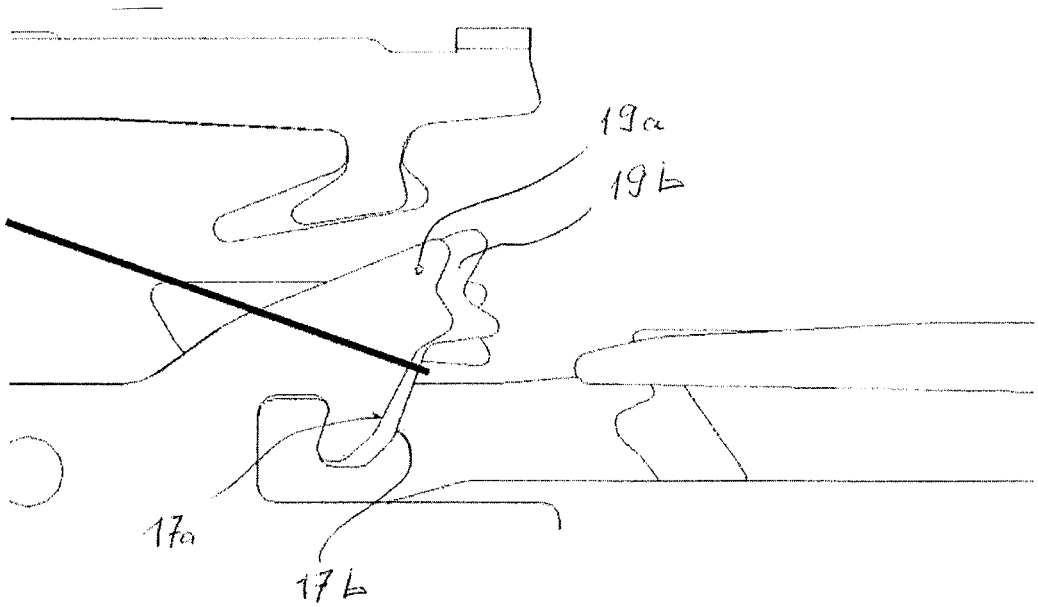
FIG. 33*c* is a detailed view of the thread cutting unit from the top after catching the upper thread.
Figure 33D:
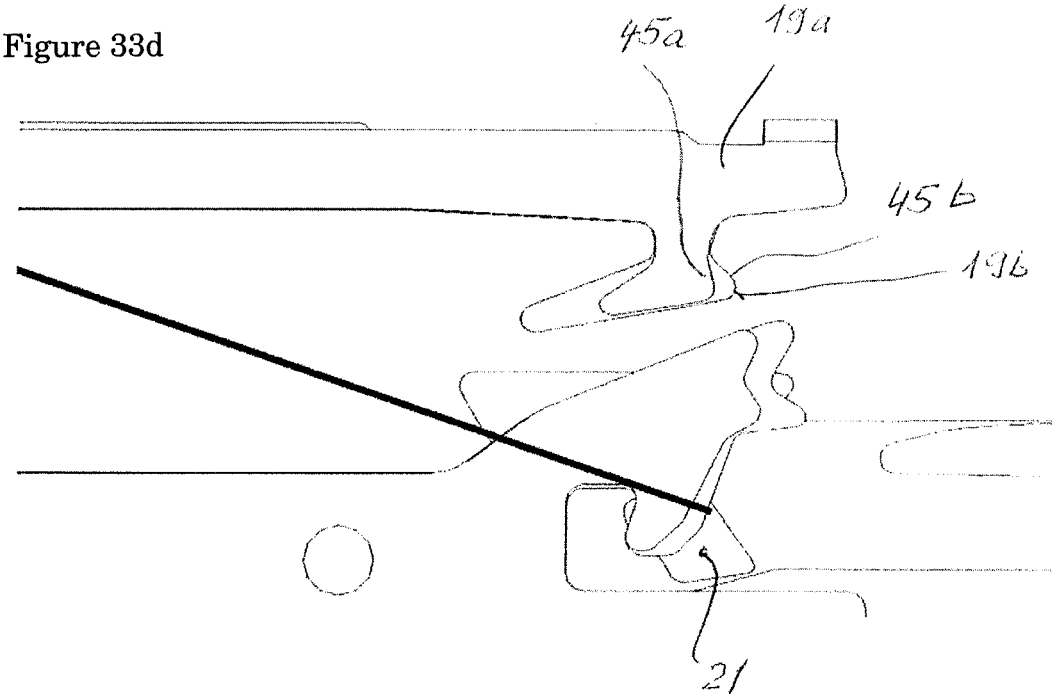
FIG. 33*d* is a view of the thread cutting unit after another step.
Figure 33E:
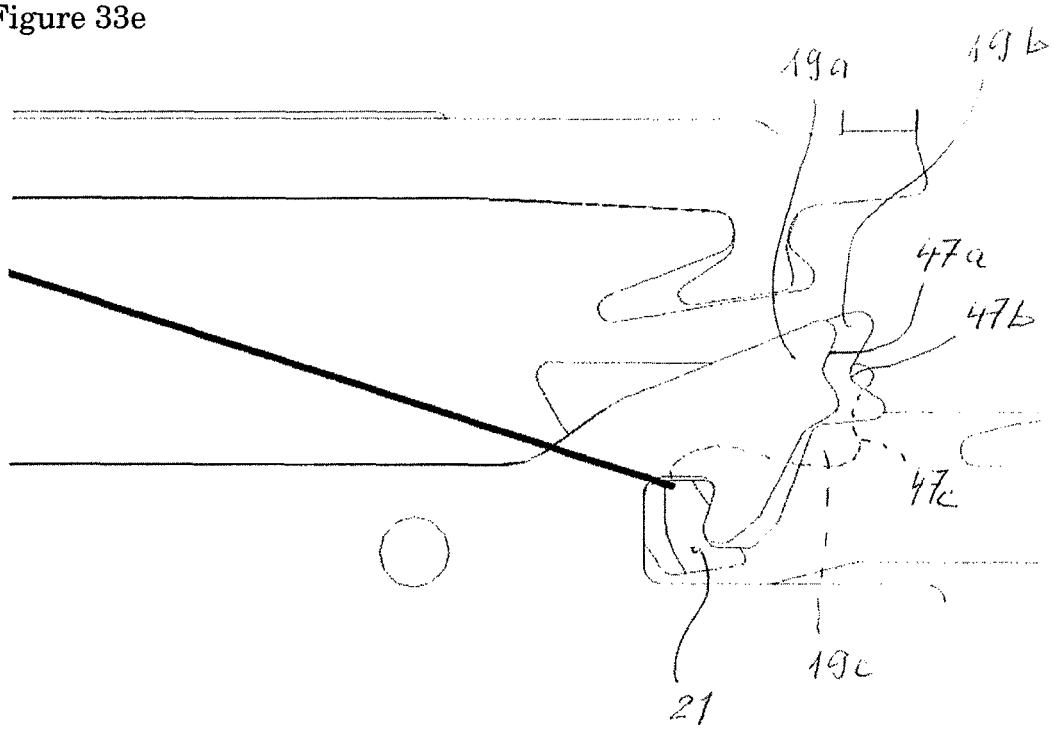
FIG. 33*e* is a view of the thread cutting unit after another step, thread in the thread receiver.

FIGS. 33*a* and 33*b* once more show the mutual arrangement of the thread catchers 19*a*-19*c* as well as the spring blade 31 in reference to the fixed arranged thread wiper unit 37 in the resting position. FIG. 33*b* shows the thread catchers 19*a*-19*c* as well as the spring blade 31 and the thread guide plate 33, which are mutually connected to each other, moved towards the right and considerably more intersecting the thread wiper unit 37. FIGS. 33*c*-33*e* shows the position of the thread during the different phases.

Figure 24:
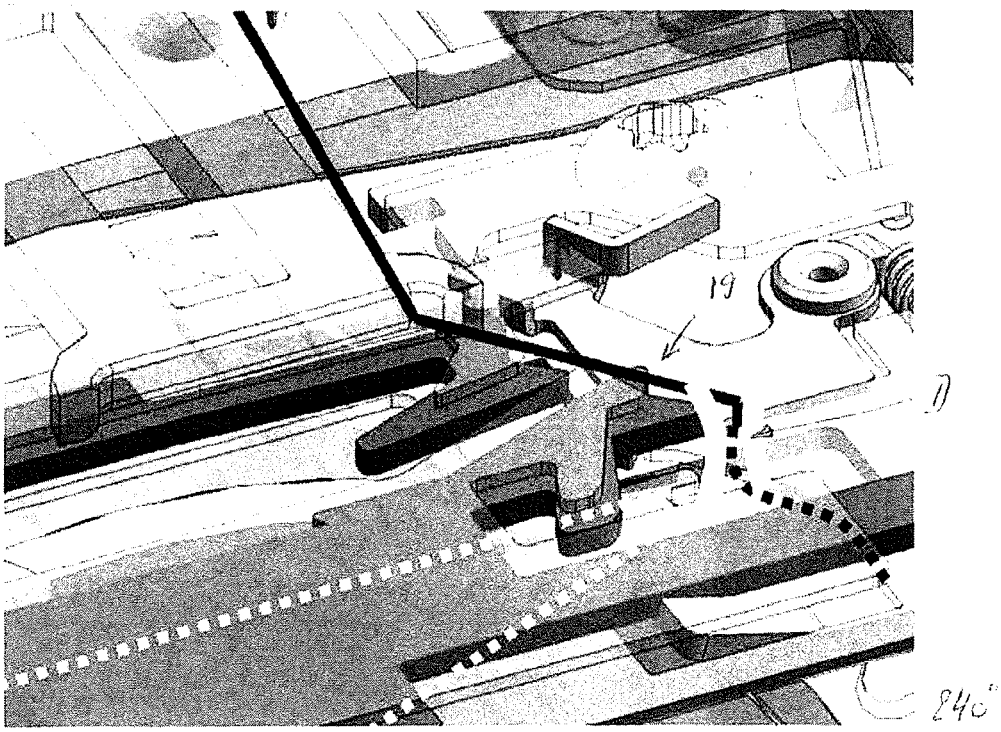
FIG. 24 is a view at 240°, the second stitch begins and the thread braking plate closes briefly and acts as a temporary thread brake, which is impinged to an increased force.

For a better understanding, FIG. 24 shows the parts of the thread cutting unit 5 in an exploded illustration.

LEGEND OF REFERENCE CHARACTERS

1 hook
3 stitching plate
5 thread cutting unit
7 upper thread
9 lower thread
11 needle
13 stitching hole
15 bobbin case
17 control edge and separating edge
19 first thread catcher, lower thread catcher
21 thread receiver
23 hook tip
25 upper thread loop
27 second thread catcher, upper thread catcher
29 blade
31 spring blade
32 front edge of 31
33 thread guide plate
35 second thread catcher
37 wiper and thread braking unit
39 thread catcher
41 thread tension plate
43 clamping plate
45 slot
47 slot
51 wiper lever
53 pin
55 second arm
59 ejection edge (lower thread)
61 clamping plate
63 loop
65 thread braking plate

The invention claimed is:

1. A method for cutting a lower and at least one upper thread at an end of a sewing or embroidering process on a sewing machine having a needle, a stitching plate with a stitching hole, and a CB-hook-type device or a CB-hook, comprising the following steps:

a) after creation of a last stitch of a seam the needle (11) approaches a surface of a material being sewn or embroidered and the stitching plate (3), b) deflecting the lower thread (9) by at least one control edge (19*a*, 19*b*, 19*c*) of a thread catcher (19) between a thread exit opening and a bobbin case (15) and the stitching hole (13), ejecting the lower thread (9) by the at least one control edge (19*a*, 19*b*, 19*c*) so that the lower thread glides into a thread receiver (21) at a thread catcher (19) while the needle (11) pierces the material, d) the thread catcher (19) reaches an end position and the needle (11) reaches a lower end position, e) engaging the upper thread (7) by a hook tip and spreading a needle thread (7*a*) and a material thread (7*b*), f) while the needle (11) moves back upwards moving the thread catcher (19) backwards and pulling back the lower thread (9) caught in the thread receiver (21) as well as pulling back the upper thread (7) also engaged by the thread catcher (19), g) simultaneously pulling the needle thread (7*a*) forward by a thread lever and subsequently severing the upper (7) and the lower thread (9), h) the thread catcher (19) reaches an initial position and pulling a loose end of the upper thread (7) using the thread lever out of the thread cutting unit (5), and i) concluding a cycle and pulling the upper (7) and the lower thread (9) forward to a required length for lead-in sewing or lead-in embroidering.

2. A method according to claim 1, wherein a loose end of the lower thread (9) is positioned by a thread wiper (37) such that during the lead-in sewing or lead-in embroidering the loose end cannot be sewn in.

3. A method for lead-in sewing or lead-in embroidering at a beginning of a sewing or embroidering process on a sewing machine having a needle, a stitching plate with a stitching hole, and hook, comprising the following steps:

a) pulling an upper and a lower thread forward to a required length above and/or below the stitching plate (3), b) the needle (11) with the upper thread (7) beginning a first stitch and pulling a loose end of the upper thread (7) under the stitching plate (3), c) the hook (1) engaging an upper thread loop, d) a thread catcher (19) approaching the upper thread loop and engaging a material thread (7*b*) and a needle thread (7*a*) of the upper thread (7) and laterally pulling the material thread (7*b*) underneath the stitching plate (3) perpendicularly in reference to a rotary axis of the hook (1), e) opening a thread braking plate and closing it shortly thereafter, while a position of the thread remains unchanged, f) the thread lever pulling the existing thread through the opened low-friction thread braking plate and concluding the first stitch, g) after a second stitch generating a tight knot at an underside of the material, h) repeating steps a) through f).

4. A device for cutting a lower and at least one upper thread at an end of a sewing or embroidering process on a sewing machine having a needle, a stitching plate with a stitching hole, and a CB-hook-type device or a CB-hook, the device comprising a thread cutting and lead-in embroidering and lead-in sewing unit (5), including several plates layered over top and connected to each other in a fixed manner as a thread catcher, a thread braking plate (31), and a thread tightening plate (41) with differently embodied contours, a drive for linear forward and backward pushing of the unit (5), and a blade (29) mounted in a fixed position relative to the thread catchers, the thread catchers comprising at least one control edge (19*a*, 19*b*, 19*c*) for deflecting a lower thread (9) between a thread exit opening and a bobbin case (15) and the stitching hole (13), the at least one control edge (19*a*, 19*b*, 19*c*) being adapted to eject the lower thread (9) so that the lower thread glides into a thread receiver (21) of the thread catcher (19) while the needle (11) pierces the material, the thread catcher (19) is movable to a forward end position as the needle (11) reaches a lower end position, and the thread catcher (19) is movable backwards to pull back the lower thread (9) caught in the thread receiver (21) and to pull back the upper thread (7) also engaged by the thread catcher (19) as the needle (11) moves back upwards, a thread lever adapted to simultaneously pull the needle thread (7*a*) forward for subsequent severing of the upper (7) and the lower thread (9), and the thread catcher (19) is movable to an initial position to pull a loose end of the upper thread (7) using the thread lever out of the thread cutting unit (5), and is adapted to conclude a cycle and pull the upper thread (7) and the lower thread (9) forward to a required length for lead-in sewing or lead-in embroidering.

5. The device according to claim 4, wherein the ends of the thread cutting and lead-in embroidering and lead-in sewing unit (5) are arranged opposite each other and locally fixed, and a wiper unit (37), cooperates therewith during a displacement of the thread cutting and lead-in stitching unit (5).

6. The device according to claim 5, wherein in that a two-arm wiper lever (51) is pivotally supported on the wiper unit (37) and is pivotal during the displacement of the thread cutting unit (5) from one arm at the central thread catcher (19*b*) to displace the end of the lower thread (9).

7. The device according to claim 6, wherein during a displacement of the thread cutting unit (5), the lower thread (9) engaged by at least one of the thread catchers (19*a*-19*c*) or the at least one upper thread (7) can be severed at the blade (29) without tension.

* * * * *

UNITED STATES PATENT AND TRADEMARK OFFICE

CERTIFICATE OF CORRECTION

PATENT NO. : 8,640,639 B2
APPLICATION NO. : 13/406855
DATED : February 4, 2014
INVENTOR(S) : Brunner et al.

It is certified that error appears in the above-identified patent and that said Letters Patent is hereby corrected as shown below:

On the Title Page insert:

--(30) Foreign Application Priority Data

Swiss Priority Application No. 00339/11, filed February 28, 2011--.

Signed and Sealed this
Twenty-seventh Day of May, 2014

Michelle K. Lee

Michelle K. Lee
*Deputy Director of the United States Patent and Trademark Office*